US010741133B2

(12) United States Patent
Choi et al.

(10) Patent No.: US 10,741,133 B2
(45) Date of Patent: Aug. 11, 2020

(54) DISPLAY DEVICE

(71) Applicant: Samsung Display Co., Ltd., Yongin-si, Gyeonggi-do (KR)

(72) Inventors: Min-Soo Choi, Hwaseong-si (KR); Eui-Myeong Cho, Anyang-si (KR); Jang-Hoon Kwak, Hwaseong-si (KR); Jun Pyo Lee, Asan-si (KR)

(73) Assignee: Samsung Display Co., Ltd. (KR)

( * ) Notice: Subject to any disclaimer, the term of this patent is extended or adjusted under 35 U.S.C. 154(b) by 0 days.

(21) Appl. No.: 15/649,431

(22) Filed: Jul. 13, 2017

(65) Prior Publication Data

US 2018/0151134 A1 May 31, 2018

(30) Foreign Application Priority Data

Nov. 30, 2016 (KR) ..... 10-2016-0161732

(51) Int. Cl.

*G09G 3/36* (2006.01)
*G09G 3/3266* (2016.01)
*G09G 3/3283* (2016.01)

(52) U.S. Cl.

CPC ..... *G09G 3/3607* (2013.01); *G09G 3/3266* (2013.01); *G09G 3/3283* (2013.01); *G09G 3/3659* (2013.01); *G09G 3/3677* (2013.01); *G09G 3/3688* (2013.01); *G09G 3/3696* (2013.01); *G09G 2300/0426* (2013.01); *G09G 2300/0814* (2013.01); *G09G 2300/0819* (2013.01); *G09G 2300/0842* (2013.01); *G09G 2310/0218* (2013.01);

(Continued)

(58) Field of Classification Search

CPC ... G09G 3/3607; G09G 3/3688; G09G 3/3696
USPC ..... 345/690; 349/41, 42, 139
See application file for complete search history.

(56) References Cited

U.S. PATENT DOCUMENTS 5,619,225 A * 4/1997 Hashimoto ..... G09G 3/2011 345/88
6,215,541 B1 * 4/2001 Song ..... G02F 1/136204 349/141

(Continued)

FOREIGN PATENT DOCUMENTS

KR 10-1117733 2/2012
KR 10-1560230 10/2015

(Continued)

*Primary Examiner* — Prabodh M Dharia
(74) *Attorney, Agent, or Firm* — Innovation Counsel LLP

(57) ABSTRACT

A display device may include first-type gate lines, second-type gate lines, a data line, and a pixel. The first-type gate lines include a first gate line. The second-type gate lines include a second gate line and traverse the first gate line. The pixel includes a first switching transistor and a second switching transistor. The first switching transistor includes a first gate electrode, a first source electrode, and a first drain electrode. The first gate electrode is electrically connected to the first gate line. The first source electrode is electrically connected to the data line. The second switching transistor includes a second gate electrode, a second source electrode, and a second drain electrode. The second gate electrode is electrically connected to the second gate line. The second source electrode is electrically connected to the first drain electrode.

20 Claims, 34 Drawing Sheets

(52) U.S. Cl.
CPC ..... *G09G 2310/0283* (2013.01); *G09G 2310/0286* (2013.01); *G09G 2310/08* (2013.01)

(56) References Cited

U.S. PATENT DOCUMENTS 6,310,667 B1 * 10/2001 Nakayoshi ..... G02F 1/1345 349/42
7,372,629 B2 * 5/2008 Uehara ..... G02B 27/2214 359/463
7,463,323 B2 * 12/2008 Kim ..... G02F 1/1309 349/139
7,696,970 B2 * 4/2010 Yokota ..... G09G 3/3688 345/209
7,990,346 B2 * 8/2011 Yamada ..... B60K 35/00 345/76
2004/0150769 A1 * 8/2004 Tokuda ..... G02F 1/133514 349/106
2005/0068057 A1 * 3/2005 Iwasaki ..... G02F 1/1309 324/759.03
2005/0110726 A1 * 5/2005 Shin ..... G09G 3/3241 345/76
2006/0285053 A1 * 12/2006 Jeoung ..... G02F 1/136259 349/149
2007/0109011 A1 * 5/2007 Jun ..... G09G 3/006 324/760.02
2007/0115231 A1 * 5/2007 Kumeta ..... G09G 3/3614 345/88
2007/0177088 A1 * 8/2007 Koyama ..... G09G 3/3233 349/139
2008/0100760 A1 * 5/2008 Lee ..... G02F 1/133514 349/37
2008/0252624 A1 * 10/2008 Jang ..... G09G 3/3648 345/204
2011/0012893 A1 * 1/2011 Iriguchi ..... G09G 3/003 345/214
2011/0017994 A1 * 1/2011 Kuo ..... G09G 3/3659 257/59
2011/0121738 A1 * 5/2011 Kawano ..... G09G 3/3233 315/130
2011/0128460 A1 * 6/2011 Cho ..... G02F 1/134363 349/41
2011/0205260 A1 * 8/2011 Weng ..... G09G 3/3648 345/691
2011/0249209 A1 * 10/2011 Ko ..... G09G 3/3648 349/41
2013/0027326 A1 * 1/2013 Kim ..... G06F 3/0412 345/173
2013/0050173 A1 * 2/2013 Koo ..... G02F 1/136204 345/212
2015/0002564 A1 * 1/2015 Sugimoto ..... G09G 3/2014 345/698
2015/0145758 A1 * 5/2015 Lee ..... G09G 3/3648 345/87
2015/0325198 A1 * 11/2015 Chen ..... H01L 27/156 345/205
2015/0379937 A1 * 12/2015 Kim ..... G09G 3/3275 345/691
2016/0035261 A1 2/2016 Park et al.
2016/0127720 A1 * 5/2016 Zhu ..... G09G 3/3648 348/54
2016/0232854 A1 * 8/2016 Lee ..... G09G 3/3291
2017/0103695 A1 * 4/2017 Nishimura ..... G09G 3/2018
2017/0301696 A1 * 10/2017 Yang ..... H01L 27/32
2018/0061318 A1 * 3/2018 Yin ..... G09G 3/3233

FOREIGN PATENT DOCUMENTS

KR 10-1641171 7/2016
KR 10-2016-0095238 8/2016

* cited by examiner

DISPLAY DEVICE

CROSS-REFERENCE TO RELATED APPLICATION

This application claims priority to and the benefit of Korean Patent Application No. 10-2016-0161732 filed in the Korean Intellectual Property Office on Nov. 30, 2016; the entire contents of the Korean Patent Application are incorporated herein by reference.

BACKGROUND

(a) Field

The technical field relates to a display device.

(b) Description of the Related Art

A display device, such as a liquid crystal display or an organic light emitting diode display, may include a plurality of pixels for displaying an image. Typically, the plurality of pixels are arranged in a matrix, are connected to a plurality of gate lines extending in a row direction, and are connected to a plurality of data lines extending in a column direction. A pixel receives a gate signal applied through the gate line, as well as a data signal that is synchronized with the gate signal and tis applied through the data line.

A gate driving circuit for sequentially outputting gate signals may be installed in a display panel including a plurality of pixels. A data driving circuit for simultaneously outputting a plurality of data signals to a plurality of data lines is complicated compared to the gate driving circuit. Therefore, the data driving circuit is not installed in the display panel, but is configured to be an external IC of the display panel. The data driving circuit may be connected to the display panel through a flexible circuit board. The driving circuit structures may limit the shape of the display device.

The above information disclosed in this Background section is for enhancement of understanding of the background of this application. The Background section may contain information that does not form the prior art already known in this country to a person of ordinary skill in the art.

SUMMARY

Embodiments may be related to a display device with a minimum number of data lines and with a desirable shape.

An embodiment may be related to a display device that includes the following elements: a plurality of first gate lines extending in a first direction; a plurality of second gate lines extending in a second direction traversing the first direction; and a plurality of pixels connected to the first gate lines and the second gate lines, wherein the pixels respectively include a first switching transistor including a gate electrode connected to the first gate line and a first electrode connected to a data line, and a second switching transistor including a gate electrode connected to the second gate line and a first electrode connected to the first switching transistor.

The display device may further include a liquid crystal capacitor connected to the second switching transistor.

The display device may further include a driving transistor connected to the second switching transistor, and a light emitting diode (LED) connected to the driving transistor.

The first direction may be a row direction, and the second direction may be a column direction.

The first direction may be a column direction, and the second direction may be a row direction.

The data line may be connected in common to pixels provided in different rows and columns.

The display device may further include a plurality of first gate driving blocks connected to the first gate lines and outputting a first gate signal, and a plurality of second gate driving blocks connected to the second gate lines and outputting a second gate signal.

When the first gate driving blocks respectively output the first gate signal as a gate-on voltage, the second gate driving blocks may sequentially output the second gate signal to the second gate lines.

When the second gate driving blocks respectively output the second gate signal as a gate-on voltage, the first gate driving blocks may sequentially output the first gate signal to the first gate lines.

The second gate driving blocks may alternately change an order of applying the second gate signal to the second gate lines between a first order and a second order that is an inverse order of the first order for each gate-on period in which one of the first gate driving blocks outputs the first gate signal.

An embodiment may be related to a display device that includes the following elements: a plurality of first gate lines extending in a first direction; a plurality of second gate lines extending in a second direction traversing the first direction; a plurality of first gate driving blocks connected to the first gate lines; and a plurality of second gate driving blocks connected to the second gate lines.

During a gate-on period in which one of the first gate driving blocks outputs a first gate signal, the second gate driving blocks may sequentially output a second gate signal to the second gate lines.

The first gate driving blocks may sequentially output the first gate signal to the first gate lines for one frame.

When the first gate driving blocks respectively output the first gate signal, the second gate driving blocks may sequentially output the second gate signal to the second gate lines.

The second gate driving blocks may alternately change an order of applying the second gate signal to the second gate lines between a first order and a second order that is an inverse order of the first order for each gate-on period in which the second gate signal is applied to the second gate lines.

The display device may further include a plurality of pixels connected to the first gate lines and the second gate lines, and a data line connected to the pixels.

The data line may be connected in common to pixels provided in different rows and columns.

The data line may include a first data line and a second data line, the first data line may be connected in common to a plurality of first pixels provided in a portion of a first region from among a display area including the pixels, and the second data line may be connected in common to a plurality of second pixels provided in another portion of a second region from among the display area.

The pixels may include a plurality of first pixels of a first color, a plurality of second pixels of a second color, and a plurality of third pixels of a third color, and the data line may include a first data line connected in common to the first pixels, a second data line connected in common to the second pixels, and a third data line connected in common to the third pixels.

The display device may further include a plurality of pixels connected to the first gate lines and the second gate lines, and arranged in the first direction and the second direction, wherein a number of pixels arranged in the first direction is changeable according to the second direction.

An embodiment may be related to a display device. The display device may include first-type gate lines, second-type gate lines, a first data line, and a first pixel. The first-type gate lines may include a first gate line and may extend parallel to one another. The second-type gate lines include a second gate line and traverse the first gate line (in a plan view of the display device). The first pixel includes a first switching transistor and a second switching transistor. The first switching transistor includes a first gate electrode, a first source electrode, and a first drain electrode. The first gate electrode is electrically connected to the first gate line. The first source electrode is electrically connected to the first data line. The second switching transistor includes a second gate electrode, a second source electrode, and a second drain electrode. The second gate electrode is electrically connected to the second gate line. The second source electrode is electrically connected to the first drain electrode.

The display device may include a liquid crystal capacitor electrically connected to the second drain electrode.

The display device may include the following elements: a driving transistor electrically connected to the second switching transistor; and a light emitting diode electrically connected to the driving transistor.

The first gate line may extend in a pixel row direction. The second gate line may extend in a pixel column direction.

The first gate line may extend in a pixel column direction. The second gate line may extend in a pixel row direction.

The first-type gate lines may include a third gate line. A total number of all pixels electrically connected to the first gate line may be unequal to a total number of all pixels electrically connected to the third gate line.

The display device may include a second pixel electrically connected to the first data line. The first-type gate lines may include a third gate line electrically connected to the second pixel. The second-type gate lines may include a fourth gate line electrically connected to the second pixel.

The display device may include the following elements: first-type gate driving units respectively electrically connected to the first-type gate lines for respectively outputting first-type gate signals to the first-type gate lines; and second-type gate driving units respectively electrically connected to the second-type gate lines for respectively outputting second-type gate signals to the second-type gate lines.

When the first gate line continues transmitting a first copy of a gate-on voltage to the first pixel for a first gate-on period, some or all of the second-type gate driving units may sequentially output a first plurality of copies of a gate-on signal in a first plurality of consecutive horizontal periods. A length the first gate-on period may be equal to a total length of the first plurality of consecutive horizontal periods.

The first-type gate lines may include a third gate line immediately neighboring the first gate line. When the third gate line continues transmitting a second copy of the gate-on voltage for a second gate-on period, the some or all of the second-type gate driving units may sequentially output a second plurality of copies of the gate-on signal in a second plurality of consecutive horizontal periods. A length the second gate-on period may be equal to a total length of the second plurality of consecutive horizontal periods.

The some or all of the second-type gate driving units may sequentially output the first plurality of copies of the gate-on signal in a first order. The some or all of the second-type gate driving units may sequentially output the second plurality of copies of the gate-on signal in a second order that is an inverse order of the first order.

An embodiment may be related to a display device. The display device may include the following elements: a plurality of first-type gate lines; a plurality of second-type gate lines traversing the first-type gate lines; first-type gate driving units respectively electrically connected to the first-type gate lines; and second-type gate driving units respectively electrically connected to the second-type gate lines.

During a gate-on period in which one of the first-type gate driving units outputs a first copy of a first gate signal, the second-type gate driving units may sequentially output a first plurality of copies of a second gate signal to the second-type gate lines.

The first gate-type driving units may sequentially output copies of the first gate signal to the first-type gate lines for one frame.

When each of the first gate driving units outputs a copy of the first gate signal, the second-type gate driving units may sequentially output a plurality of copies of the second gate signal to the second-type gate lines.

The second-type gate driving units may alternate orders of applying pluralities of copies of the second gate signal to the second-type gate lines between a first order and a second order that is an inverse order of the first order in consecutive gate-on periods.

The display device may include the following elements: a plurality of pixels having gate electrodes electrically connected to the first-type gate lines and the second-type gate lines, arranged in pixel rows and pixel columns, and including a first pixel, the first pixel being electrically connected to both one of the first-type gate lines and one of the second-type gate lines; and a first data line electrically connected to source electrodes of some or all of the pixels.

The first data line may be electrically connected to pixels positioned in different ones of the pixel rows and may be electrically connected to pixels positioned in different ones of the pixel columns.

The display device may include a second data line electrically insulated from (and not electrically connected to) the first data line. The pixels may include first-region pixels and second region-pixels. The first-region pixels may be positioned in a first region of the display device. The second-region pixels may be positioned in a second region of the display device. The first data line may be electrically connected to each of the first-region pixels. The second data line may be electrically connected to each of the second-region pixels.

The display device may include the following elements: a second data line electrically insulated from the first data line; and a third data line electrically insulated from each of the first data line and the second data line. The pixels may include a plurality of first-color pixels of a first color, a plurality of second-color pixels of a second color, and a plurality of third-color pixels of a third color. The first data line may be electrically connected to a source electrode of each of the first-color pixels. The second data line may be electrically connected to a source electrode of each of the second-color pixels. The third data line may be electrically connected to a source electrode of each of the third-color pixels.

The display device may include a plurality of pixels. Each of the pixels may be electrically connected to at least one of the first-type gate lines and at least one of the second-type gate lines. The first-type gate lines may include a first gate line and a second gate line. A total number of all pixels electrically connected to the first gate line may be unequal to a total number of all pixels electrically connected to the second gate line.

According to embodiments, a display device may have a minimum number of data lines, may have a minimum width of a flexible circuit board, and may have a desirable shape.

DETAILED DESCRIPTION

Figure 1:
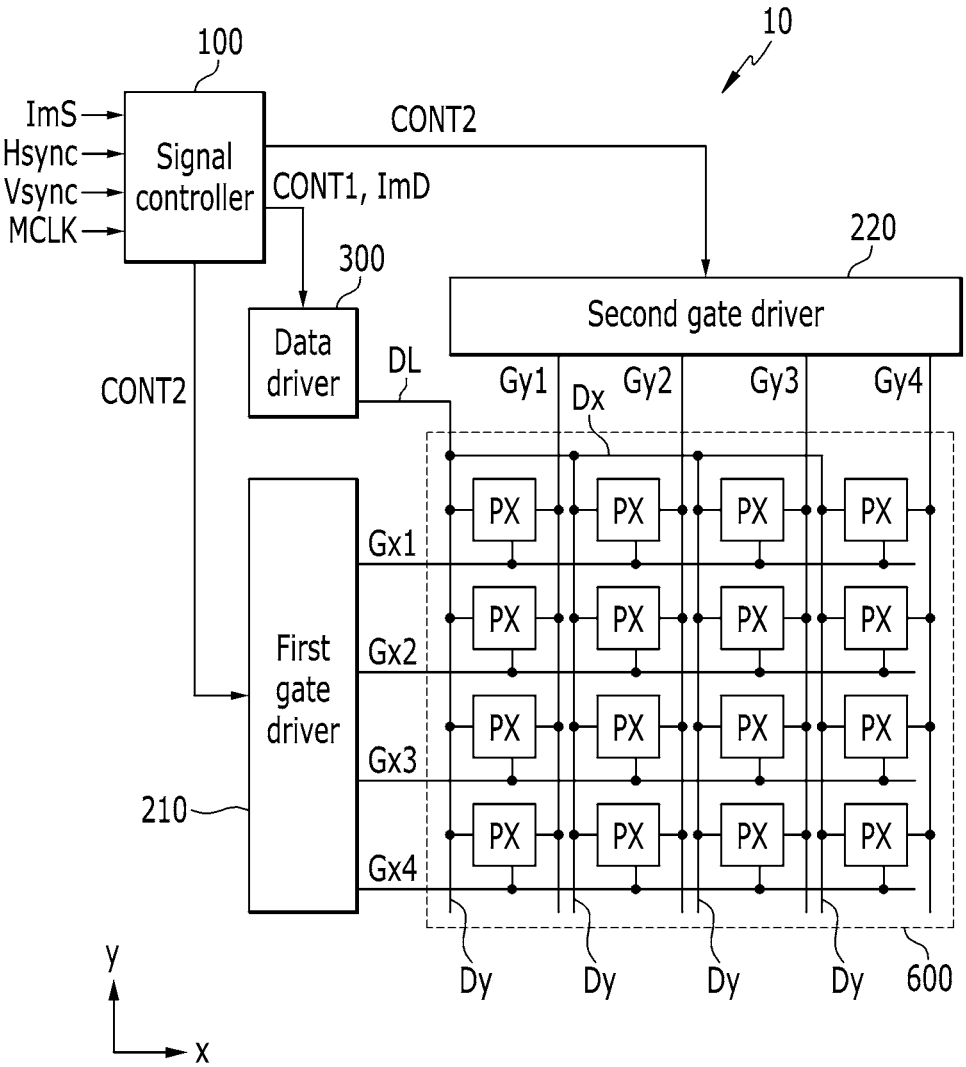
FIG. 1 shows a block diagram of a display device according to an embodiment.

Embodiments are described with reference to the accompanying drawings. As those skilled in the art would realize, the described embodiments may be modified in various ways.

Although the terms "first", "second", etc. may be used herein to describe various elements, these elements, should not be limited by these terms. These terms may be used to distinguish one element from another element. Thus, a first element discussed below may be termed a second element without departing from teachings of one or more embodiments. The description of an element as a "first" element may not require or imply the presence of a second element or other elements. The terms "first", "second", etc. may also be used herein to differentiate different categories or sets of elements. For conciseness, the terms "first", "second", etc. may represent "first-category (or first-set)", "second-category (or second-set)", etc., respectively.

The drawings and description are to be regarded as illustrative in nature and not restrictive. Like reference numerals may designate like elements.

Sizes and thicknesses shown in the drawings are for understanding and description and may be exaggerated for clarity.

When a first element (such as a layer, film, region, or substrate) is referred to as being "on" a second element, the first element can be directly on the second element, or at least one intervening element may be present between the first element and the second element. When a first element is referred to as being "directly on" a second element, there are no intended intervening elements (except for environmental elements such as air) present between the first element and the second element. The word "on" or "above" means being positioned on or below an object, and does not necessarily mean being positioned on the upper side of the object based on a gravitational direction.

Unless explicitly described to the contrary, the word "comprise" and variations such as "comprises" or "comprising" may imply the inclusion of stated elements but not the exclusion of any other elements. The term "connect" may mean "electrically connect".

A display device according to an exemplary embodiment of the present invention is described with reference to FIG. 1 to FIG. 10.

FIG. 1 shows a block diagram of a display device according to an embodiment.

Referring to FIG. 1, the display device 10 includes a signal controller 100, a first gate driver 210, a second gate driver 220, a data driver 300, and a display unit 600.

The signal controller 100 receives an image signal (ImS) and a synchronization signal from an external device. The image signal (ImS) includes luminance information on a plurality of pixels. The luminance may have 1024 ($=2^{10}$), 256 ($=2^8$), or 64 ($=2^6$) gray levels. The synchronization signal includes a horizontal synchronizing signal Hsync, a vertical synchronization signal Vsync, and a main clock signal MCLK.

The signal controller 100 generates a first driving control signal CONT1, a second driving control signal CONT2, and an image data signal (ImD) according to the image signal (ImS), the horizontal synchronizing signal Hsync, the vertical synchronization signal Vsync, and the main clock signal MCLK.

The signal controller 100 distinguishes the image signal (ImS) according to the vertical synchronization signal Vsync for each frame, and distinguishes the image signal (ImS) according to the horizontal synchronizing signal Hsync for each gate line to generate the image data signal (ImD). The signal controller 100 transmits the image data signal (ImD) to the data driver 300 together with the first driving control signal CONT1.

The display unit 600 is a display area including a plurality of pixels PX. On the display unit 600, a plurality of first gate lines (Gx1, Gx2, Gx3, and Gx4) extending in a first direction (x) to be substantially parallel to each other, a plurality of second gate lines (Gy1, Gy2, Gy3, and Gy4) extending in a second direction (y) to be substantially parallel to each other, and a data line (DL) are formed to be connected to a plurality of pixels PX. The data line (DL) may include a first sub-data line (Dx) extending in the first direction (x) and a plurality of second sub-data lines (Dy) extending in a second direction (y) from the first sub-data line (Dx). A plurality of pixels PX may be connected to a plurality of second sub-data lines (Dy). The first sub-data line (Dx) and a plurality of second sub-data lines (Dy) are connected to each other so a plurality of pixels PX may be connected in common to one data line (DL). That is, pixels PX provided in different rows and columns may be connected to the same data line (DL).

The second direction (y) may be a direction traversing the first direction (x). The first direction (x) may be a row direction, and the second direction (y) may be a column direction. The first direction (x) is shown to be the row direction and the second direction (y) is shown to be the column direction, but the first direction (x) may be a column direction and the second direction (y) may be a row direction. For ease of description, the first direction (x) may be the row direction, and the second direction (y) may be the column direction.

A plurality of pixels PX may respectively emit one of primary colors. The primary colors may include red, green, and blue, and desired colors may be displayed by a spatial sum or a temporal sum of the three primary colors. A color may be displayed by a red pixel, a green pixel, and a blue pixel, and a combination of the red pixel, the green pixel, and the blue pixel may be referred to as a pixel.

The first gate driver 210 is connected to a plurality of first gate lines (Gx1, Gx2, Gx3, and Gx4), and generates a plurality of first gate signals according to a second driving control signal CONT2. The first gate driver 210 may apply a plurality of first gate signals with a gate-on voltage to a plurality of first gate lines (Gx1, Gx2, Gx3, and Gx4).

The second gate driver 220 is connected to a plurality of second gate lines (Gy1, Gy2, Gy3, and Gy4), and generates a plurality of second gate signals according to the second driving control signal CONT2. The second gate driver 220 may apply a plurality of second gate signals with a gate-on voltage to a plurality of second gate lines (Gy1, Gy2, Gy3, and Gy4).

During a first gate-on period in which the first gate driver 210 outputs a first gate signal with a gate-on voltage to one of a plurality of first gate lines (Gx1, Gx2, Gx3, and Gx4), the second gate driver 220 may sequentially output a plurality of second gate signals with a gate-on voltage to a plurality of second gate lines (Gy1, Gy2, Gy3, and Gy4).

In an embodiment, during a second gate-on period in which the second gate driver 220 outputs a second gate signal with a gate-on voltage to a plurality of second gate lines (Gy1, Gy2, Gy3, and Gy4), the first gate driver 210 may sequentially output a plurality of first gate signals with a gate-on voltage to a plurality of first gate lines (Gx1, Gx2, Gx3, and Gx4).

A method for driving the first gate driver 210 and the second gate driver 220 will be described in detail in a latter portion of the present specification.

The data driver 300 is connected to the data line (DL), samples and holds the image data signal (ImD) according to the first driving control signal CONT1, and applies a data signal to the data line (DL). The data driver 300 is synchronized at a time when a plurality of first gate signals and a plurality of second gate signals applied to a plurality of first gate lines (Gx1, Gx2, Gx3, and Gx4) and a plurality of second gate lines (Gy1, Gy2, Gy3, and Gy4) become a gate-on voltage, and it applies a data signal caused by the image data signal (ImD) to the data line (DL).

For ease of description, it is shown in FIG. 1 that a plurality of pixels PX are disposed by fours in the first direction (x) and the second direction (y), and the first gate lines (Gx1, Gx2, Gx3, and Gx4) and the second gate lines (Gy1, Gy2, Gy3, and Gy4) connected thereto are disposed by fours, but in the present invention, the number of the pixels PX, the number of the first gate lines (Gx1, Gx2, Gx3, and Gx4), and the number of the second gate lines (Gy1, Gy2, Gy3, and Gy4) are not limited.

Figure 2:
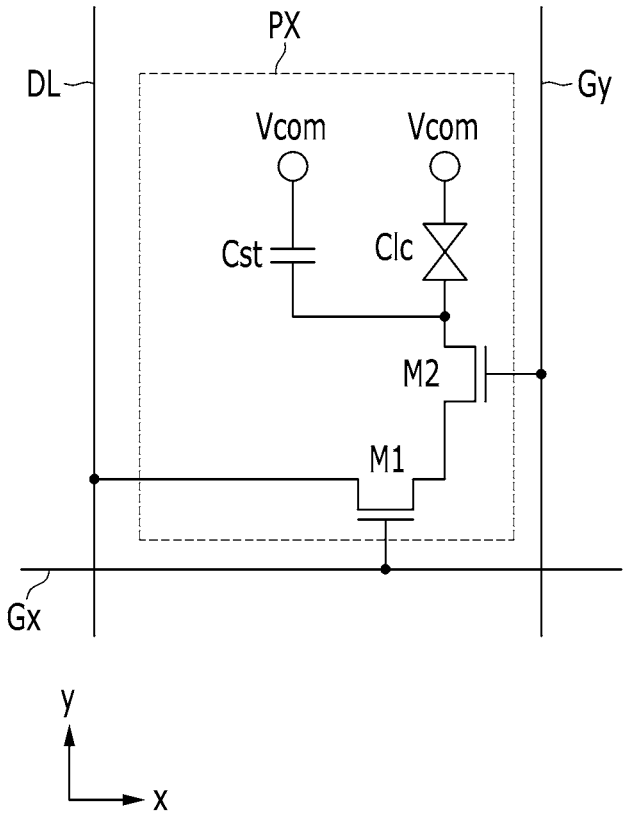
FIG. 2 shows a circuit diagram of a pixel t included in a display device according to an embodiment.

FIG. 2 shows a circuit diagram of a pixel to be included in a display device of FIG. 1. The circuit diagram of FIG. 2 represents a random pixel PX included in the display device of FIG. 1.

Referring to FIG. 2, the pixel PX includes a first switching transistor M1, a second switching transistor M2, a liquid crystal capacitor Clc, and a storage capacitor Cst.

The first switching transistor M1 includes a gate electrode connected to a first gate line (Gx), a first electrode (or source electrode) connected to the data line (DL), and a second electrode (or drain electrode) connected to the second switching transistor M2. The first switching transistor M1 is turned on by the first gate signal with a gate-on voltage applied to the first gate line (Gx) to transmit the data signal applied to the data line (DL) to the second switching transistor M2.

The second switching transistor M2 includes a gate electrode connected to the second gate line (Gy), a first electrode (or source electrode) connected to the first switching transistor M1, and a second electrode (or drain electrode) connected to a liquid crystal capacitor Clc. The second switching transistor M2 is turned on by the second gate signal with a gate-on voltage applied to the second gate line (Gy) to transmit the data signal transmitted through the first switching transistor M1 to the liquid crystal capacitor Clc.

The first switching transistor M1 and the second switching transistor M2 may be N-channel electric field effect transistors. The gate-on voltage for turning on the N-channel electric field effect transistor is a high-level voltage, and the gate-off voltage for turning off the N-channel electric field effect transistor is a low level voltage.

In an embodiment, the first switching transistor M1 and the second switching transistor M2 may be P-channel electric field effect transistors. The gate-on voltage for turning on the P-channel electric field effect transistor is a low-level voltage, and the gate-off voltage for turning off the P-channel electric field effect transistor is a high-level voltage.

The first switching transistor M1 and the second switching transistor M2 may be N-channel electric field effect transistors.

The liquid crystal capacitor Clc includes a pixel electrode 618, a common electrode 624, and a liquid crystal layer 3 to be described with reference to FIG. 3 and FIG. 4. The pixel electrode 618 may be connected to the second switching transistor M2, and it may receive a data signal through the second switching transistor M2. The common electrode 624 receives a common voltage Vcom. The liquid crystal capacitor Clc includes the pixel electrode 618 and the common electrode 624 as two terminals, and the liquid crystal layer 3 between the pixel electrode 618 and the common electrode 624 functions as a dielectric material.

The storage capacitor Cst includes a first electrode connected to the liquid crystal capacitor Clc and a second electrode connected to the common voltage Vcom.

Figure 3:
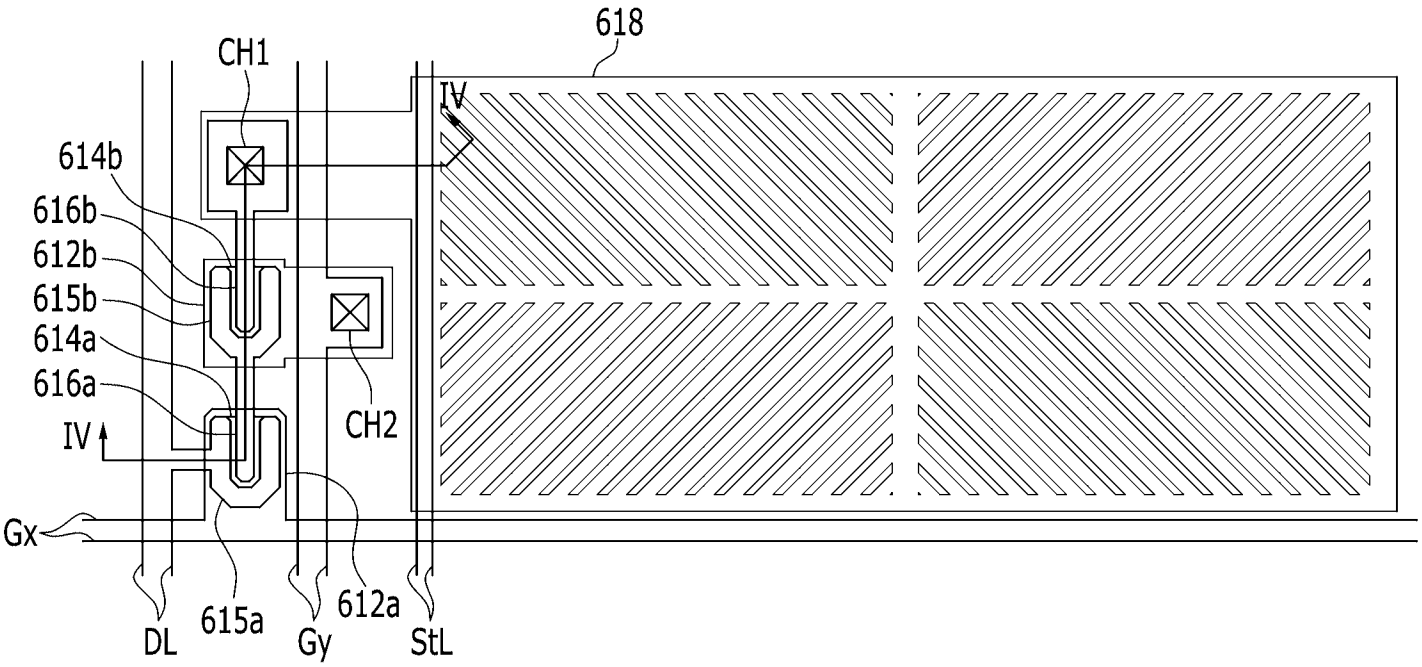
FIG. 3 shows a top plan view of a pixel area of a display device according to an embodiment.

FIG. 3 shows a top plan view of a pixel area of a display device of FIG. 1. FIG. 4 shows a cross-sectional view of FIG. 3 with respect to a line IV-IV. FIG. 3 may show an array of one pixel PX included in the display device illustrated in FIG. 1.

Figure 4:
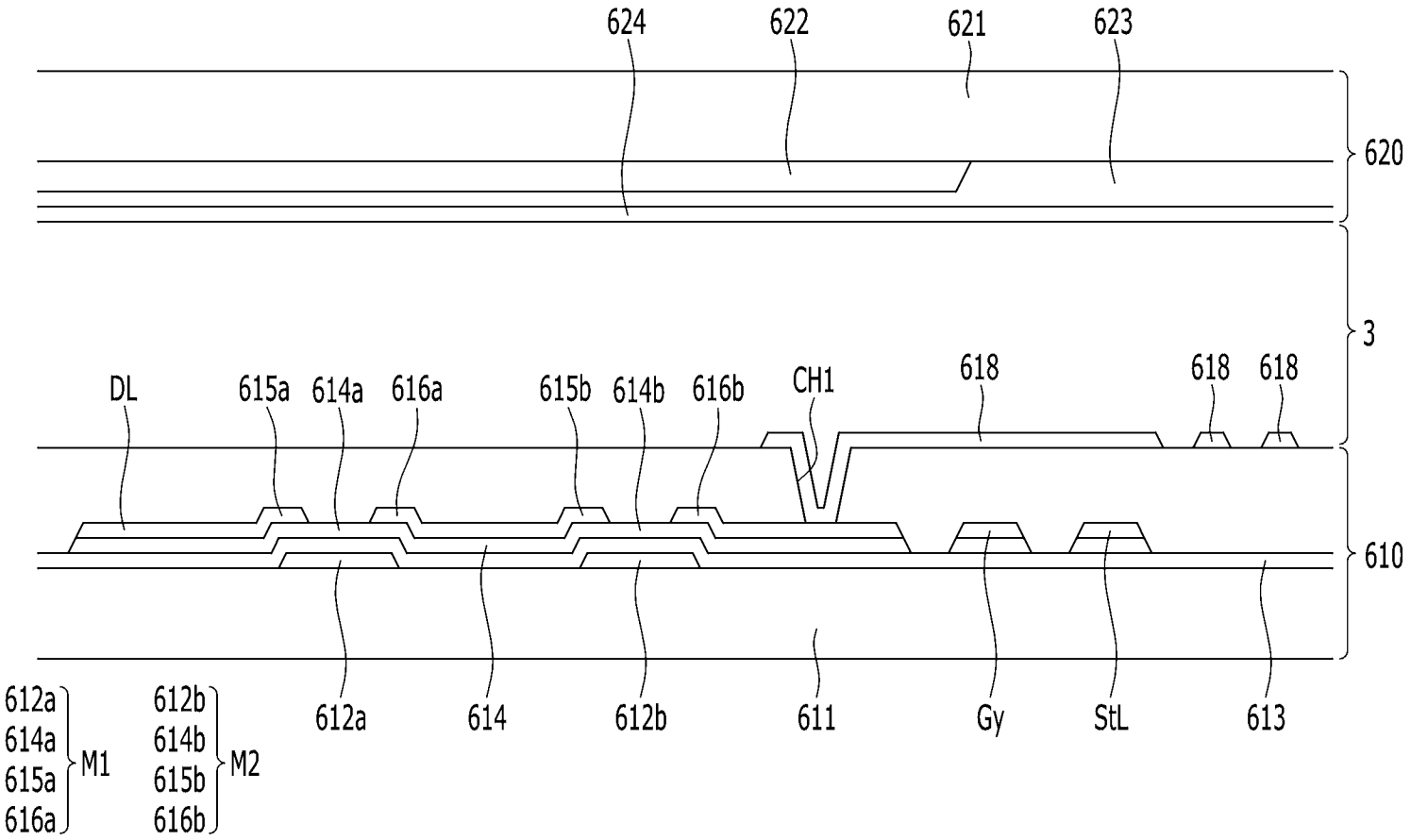
FIG. 4 shows a cross-sectional view of FIG. 3 with respect to a line IV-IV according to an embodiment.

Referring to FIG. 3 and FIG. 4, the display device 10 includes a first display panel 610 and a second display panel 620 facing each other, and a liquid crystal layer 3 provided between the panels 610 and 620.

The first display panel 610 is described.

The first display panel 610 includes a first gate line (Gx) provided on a first substrate 611, a second gate line (Gy), a data line (DL), a first switching transistor M1, a second switching transistor M2, a pixel electrode 618, and a storage electrode line (StL). Here, a top of the first substrate 611 signifies a direction facing a second substrate 621.

The first substrate 611 may include transparent glass or plastic.

The first gate line (Gx) is provided on the first substrate 611, and extends in the first direction (x). The first gate line (Gx) may include a first gate electrode 612*a*. The first gate electrode 612*a* is connected to the first gate line (Gx). A second gate electrode 612*b* may be provided on a same layer as the first gate electrode 612*a*, and the second gate electrode 612*b* may be formed together when the first gate line (Gx) and the first gate electrode 612*a* are formed.

A gate insulating layer 613 is provided on the gate line (Gx), the first gate electrode 612*a*, and the second gate electrode 612*b*.

A semiconductor layer 614 is provided on the gate insulating layer 613. The semiconductor layer 614 may include a first semiconductor 614*a* and a second semiconductor 614*b*.

A data line (DL), a first electrode 615*a* and a second electrode 616*a* of the first switching transistor M1, a first electrode 615*b* and a second electrode 616*b* of the second switching transistor M2, a second gate line (Gy), and a storage electrode line (StL) are provided on the semiconductor layer 614.

The first gate electrode 612*a*, the first electrode 615*a*, the second electrode 616*a*, and the first semiconductor 614*a* may configure a first switching transistor M1. The first electrode 615*a* faces the second electrode 616*a* with a portion of the first semiconductor 614*a* being positioned between the electrodes 615*a* and 616*a*. The first electrode 615*a* and the second electrode 616*a* may overlap the first gate electrode 612*a* with the first semiconductor 614*a* being positioned between the electrode 612*a* and each of the electrodes 615*a* and 616*a*. A channel of the first switching transistor M1 is formed on the first semiconductor 614*a* between the first electrode 615*a* and the second electrode 616*a*.

The second gate line (Gy) extends in the second direction (y), and is connected to the second gate electrode 612*b* through a second contact hole CH2. The second contact hole CH2 may be provided on a position where the second gate line (Gy) overlaps the second gate electrode 612*b*.

The second gate electrode 612*b*, the first electrode 615*b*, the second electrode 616*b*, and the second semiconductor 614*b* may configure a second switching transistor M2. The first electrode 615*b* faces the second electrode 616*b* with a portion of the second semiconductor 614*b* being positioned between the electrodes 615*b* and 616*b*. The first electrode 615*b* and the second electrode 616*b* may overlap the second gate electrode 612*b* with the second semiconductor 614*b* being positioned between the electrode 612*b* and each of the electrodes 615*b* and 616*b*. A channel of the second switching transistor M2 is formed on the second semiconductor 614*b* between the first electrode 615*b* and the second electrode 616*b*.

The first electrode 615*a* of the first switching transistor M1 is connected to the data line (DL) extending in the second direction (y). The second electrode 616*a* of the first switching transistor M1 is connected to the first electrode 615*b* of the second switching transistor M2.

The storage electrode line (StL) may extend in the second direction (y). A common voltage Vcom may be applied to the storage electrode line (StL), and the storage electrode line (StL) may overlap the pixel electrode 618 to form a storage capacitor Cst. Here, the storage electrode line (StL) extends in the second direction (y). In an embodiment, the storage electrode line (StL) may have a specific pattern extending in the first direction (x) or overlapping the pixel electrode 618.

A passivation layer 617 is provided on the data line (DL), the first electrode 615*a* and the second electrode 616*a* of the first switching transistor M1, the first electrode 615*b* and the second electrode 616*b* of the second switching transistor M2, the second gate line (Gy), and the storage electrode line (StL). The passivation layer 617 may be an inorganic insulating layer or an organic insulator. The passivation layer 617 includes a first contact hole CH1 overlapping the second electrode 616*b* of the second switching transistor M2.

The pixel electrode 618 is provided on the passivation layer 617. The pixel electrode 618 is connected to the second electrode 616*b* of the second switching transistor M2 through the first contact hole CH1. The pixel electrode 618 may include a transparent conductive material such as an ITO or an IZO. The pixel electrode 618 is shown in FIG. 3 to include a plurality of branch electrodes, but the present invention is not limited thereto, and the pixel electrode 618 may have various forms.

The second display panel 620 is described.

The second display panel 620 includes a light blocking member 622, a color filter 623, and a common electrode 624 provided on the second substrate 621. Here, a top of the second substrate 621 signifies a direction facing the first substrate 611.

The light blocking member 622 is provided to overlap the data line (DL), the first gate line (Gx), the second gate line (Gy), the first switching transistor M1, and the second switching transistor M2. The light blocking member 622 prevents leakage of light that may occur around the data line (DL), the first gate line (Gx), the second gate line (Gy), the first switching transistor M1, and the second switching transistor M2.

The color filter 623 may generally overlap the pixel electrode 618, and may overlap part of the light blocking member 622.

The common electrode 624 is provided on the color filter 623. The common electrode 624 may be provided on an entire side of the second substrate 621, and the common voltage Vcom is applied to the common electrode 624.

The liquid crystal layer 3 includes liquid crystal molecules with positive dielectric anisotropy or negative dielectric anisotropy, and the liquid crystal molecules are rearranged by an electric field generated between the pixel electrode 618 and the common electrode 624.

Figure 5:
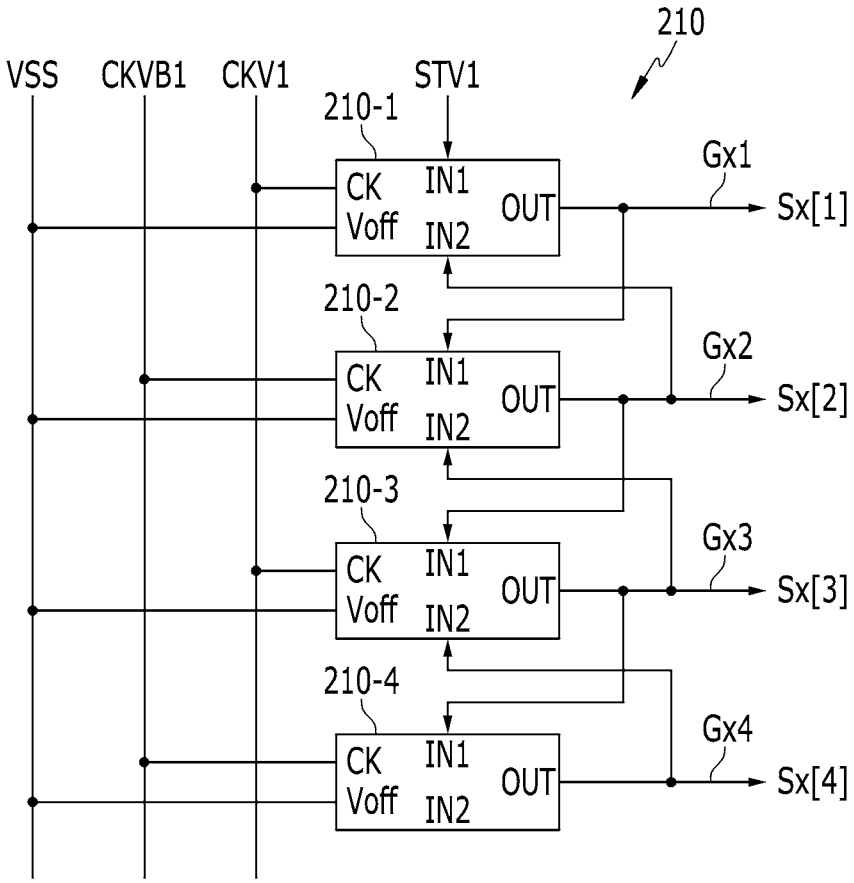
FIG. 5 shows a block diagram of a first gate driver included in a display device according to an embodiment.

FIG. 5 shows a block diagram of a first gate driver to be included in a display device of FIG. 1.

Referring to FIG. 5, the first gate driver 210 includes a plurality of first gate driving blocks (210-1, 210-2, 210-3, and 210-4).

The plurality of first gate driving blocks (210-1, 210-2, 210-3, and 210-4) respectively include a first input end IN1, a second input end IN2, a clock signal input end (CK), a driving voltage input end Voff, and an output end (OUT).

The plurality of first gate driving blocks (210-1, 210-2, 210-3, and 210-4) may be connected to a plurality of first gate lines (Gx1, Gx2, Gx3, and Gx4), respectively. The plurality of first gate driving blocks (210-1, 210-2, 210-3, and 210-4) may receive a first driving voltage (VSS), and may sequentially output a plurality of first gate signals (Sx[1], Sx[2], Sx[3], and Sx[4]) in synchronization with the first clock signal (CKV1) and the second clock signal (CKVB1). The second clock signal (CKVB1) may be an inverse clock signal of the first clock signal (CKV1).

First input ends IN1 of a plurality of first gate driving blocks (210-1, 210-2, 210-3, and 210-4) receive a first gate start signal STV1 or the previously-output first gate signals (Sx[1], Sx[2], and Sx[3]). The first input end IN1 of the first gate driving block 210-1 connected to the first gate line Gx1 in the first row may receive the first gate start signal STV1, and the first input ends IN1 of the remaining first gate driving blocks (210-2, 210-3, and 210-4) may receive the first gate signals (Sx[1], Sx[2], and Sx[3]) of the first gate driving blocks (210-1, 210-2, and 210-3) of the previous stage.

Second input ends IN2 of a plurality of first gate driving blocks (210-1, 210-2, and 210-3) receive first gate signals (Sx[2], Sx[3], and Sx[4]) of the first gate driving blocks (210-2, 210-3, and 210-4) of the next stage. The second input end IN2 of the first gate driving block 210-4 of the last stage may receive a gate signal from a dummy first gate driving block (not shown) of the next stage.

The dummy first gate driving block may receive the first gate signal (Sx[4]), the first clock signal CKV1, and the first driving voltage (VSS) to generate a first gate signal.

The clock signal input ends (CK) of a plurality of first gate driving blocks (210-1, 210-2, 210-3, and 210-4) receive the first clock signal (CKV1) or the second clock signal (CKVB1). The clock signal input ends (CK) of the first gate driving blocks (210-1 and 210-3) in an odd-numbered row receive the first clock signal CKV1, and the clock signal input ends (CK) of the first gate driving blocks (210-2 and 210-4) in an even-numbered row may receive the second clock signal (CKVB1).

Respective driving voltage input ends Voff of a plurality of first gate driving blocks (210-1, 210-2, 210-3, and 210-4) may receive the first driving voltage (VSS). The first driving voltage (VSS) may be a gate-off voltage.

Figure 6:
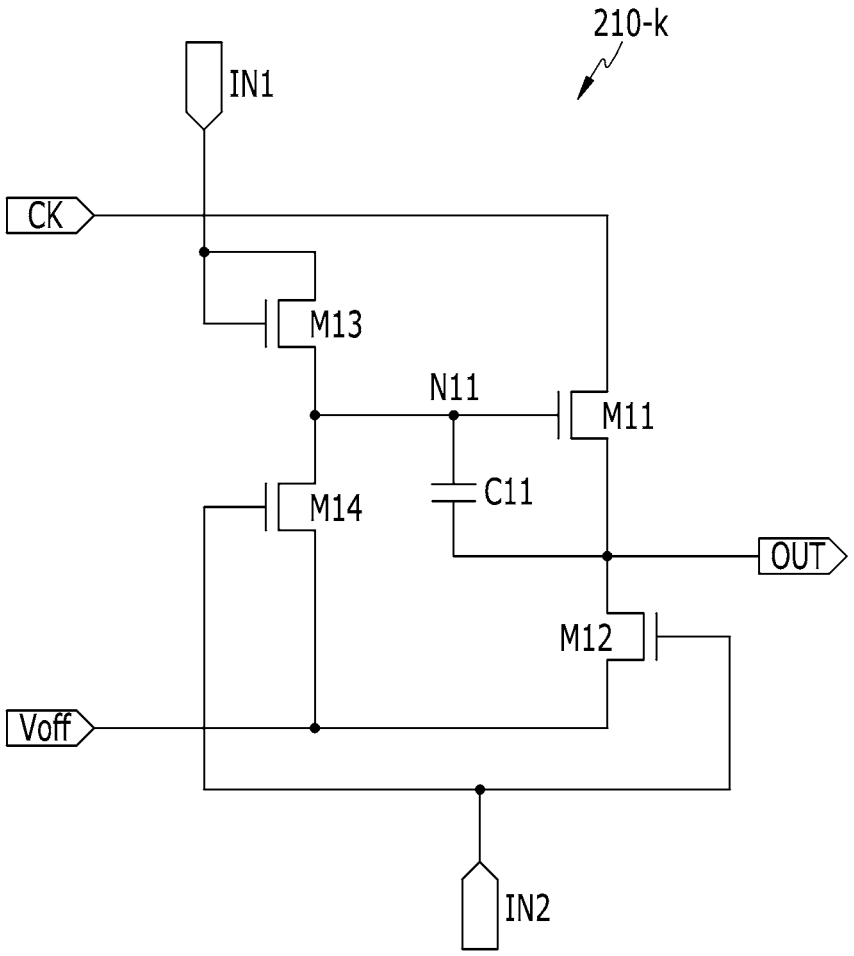
FIG. 6 shows a circuit diagram of a first gate driving block included in a first gate driver according to an embodiment.

Output ends (OUT) of a plurality of first gate driving blocks (210-1, 210-2, 210-3, and 210-4) are connected to a plurality of first gate lines (Gx1, Gx2, Gx3, and Gx4), respectively FIG. 6 shows a circuit diagram of a first gate driving block included in a first gate driver of FIG. 5. The circuit diagram of FIG. 6 represents one first gate driving block **210-*k*** from among a plurality of first gate driving blocks.

Referring to FIG. 6, the first gate driving block **210-*k* includes a first transistor M11, a second transistor M12, a third transistor M13, a fourth transistor M14, and a first capacitor C11**.

The first transistor M11 includes a gate electrode connected to the first node N11, a first electrode connected to the clock signal input end (CK), and a second electrode connected to the output end (OUT).

The second transistor M12 includes a gate electrode connected to the second input end IN2, a first electrode connected to the driving voltage input end Voff, and a second electrode connected to the output end (OUT).

The third transistor M13 includes a gate electrode connected to the first input end IN1, a first electrode connected to the first input end IN1, and a second electrode connected to the first node N11.

The fourth transistor M14 includes a gate electrode connected to the second input end IN2, a first electrode connected to the driving voltage input end Voff, and a second electrode connected to the first node N11.

The first transistor M11, the second transistor M12, the third transistor M13, and the fourth transistor M14 may be N-channel electric field effect transistors. In an embodiment, the first transistor M11, the second transistor M12, the third transistor M13, and the fourth transistor M14 may be P-channel electric field effect transistors.

The first capacitor C11 includes a first electrode connected to the first node N11 and a second electrode connected to the output end (OUT).

When the first input end IN1 receives the first gate start signal STV1 or the gate signal (Sx[k−1]) with a gate-on voltage, the third transistor M13 is turned on, and the gate-on voltage is transmitted to the first node N11. By the gate-on voltage at the first node N11, the first transistor M11 is turned on and the clock signal input to the clock signal input end (CK) is output to the output end (OUT) as the first gate signal (Sx[k]) with a gate-on voltage. The first capacitor C11 may store the gate-on voltage at the first node N11 to maintain the turn-on state of the first transistor M11. In this instance, the second input end IN2 receives a gate-off voltage to turn off the second transistor M12 and the fourth transistor M14.

When the output end (OUT) outputs the first gate signal (Sx[k]) and the second input end IN2 receives the first gate signal (Sx[k+1]) with a gate-on voltage, the second transistor M12 and the fourth transistor M14 are turned on, and the first driving voltage (VSS) with a gate-off voltage is transmitted to the output end (OUT) and the first node N11. The output end (OUT) outputs the first gate signal (Sx[k]) with a gate-off voltage. The first transistor M11 is turned off by the gate-off voltage at the first node N11.

Figure 7:
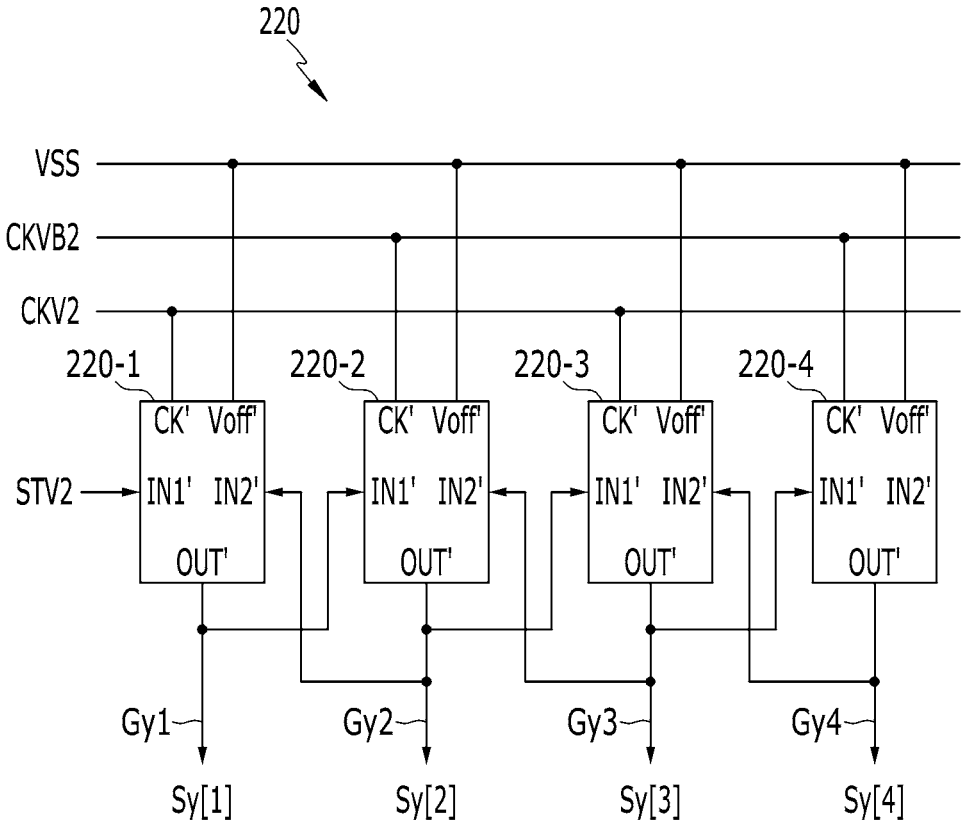
FIG. 7 shows a block diagram of a second gate driver included in a display device according to an embodiment.

FIG. 7 shows a block diagram of a second gate driver that may be included in a display device of FIG. 1.

Referring to FIG. 7, the second gate driver 220 includes a plurality of second gate driving blocks (220-1, 220-2, 220-3, and 220-4).

The plurality of second gate driving blocks (220-1, 220-2, 220-3, and 220-4) respectively include a first input end (IN1'), a second input end (IN2'), a clock signal input end (CK'), a driving voltage input end (Voff'), and an output end (OUT').

The plurality of second gate driving blocks (220-1, 220-2, 220-3, and 220-4) may be connected to a plurality of second gate lines (Gy1, Gy2, Gy3, and Gy4), respectively. The plurality of second gate driving blocks (220-1, 220-2, 220-3, and 220-4) may receive the first driving voltage (VSS), and may sequentially output a plurality of second gate signals (Sy[1], Sy[2], Sy[3], and Sy[4]) in synchronization with the third clock signal (CKV2) and the fourth clock signal (CKVB2). The fourth clock signal (CKVB2) may be an inverse clock signal of the third clock signal CKV2.

First input ends (IN1') of the plurality of second gate driving blocks (220-1, 220-2, 220-3, and 220-4) receive the second gate start signal STV2 or the previously-output second gate signals (Sy[1], Sy[2], and Sy[3]). The first input end (IN1') of the second gate driving block 220-1 connected to the second gate line Gy1 of the first column may receive the second gate start signal STV2, and the first input ends (IN1') of the remaining second gate driving blocks (220-2, 220-3, and 220-4) may receive the second gate signals (Sy[1], Sy[2], and Sy[3]) of the second gate driving blocks (220-1, 220-2, and 220-3) of the previous stage.

Second input ends (IN2') of the plurality of second gate driving blocks (220-1, 220-2, 220-3, and 220-4) receive the second gate signals (Sy[2], Sy[3], and Sy[4]) of the second gate driving blocks (220-2, 220-3, and 220-4) of the next stage. The second input end (IN2') of the second gate driving block 220-4 of the last stage may receive the gate signal from a dummy second gate driving block (not shown) of the next stage.

The dummy second gate driving block may receive the second gate signal (Sy[4]), the third clock signal CKV2, and the first driving voltage (VSS) to generate a second gate signal.

The clock signal input ends (CK') of the plurality of second gate driving blocks (220-1, 220-2, 220-3, and 220-4) receive the third clock signal (CKV2) or the fourth clock signal (CKVB2). The clock signal input ends (CK') of the second gate driving blocks (220-1 and 220-3) in the odd-numbered column may receive the third clock signal CKV2, and the clock signal input ends (CK') of the second gate driving blocks (220-2 and 210-4) in the even-numbered column may receive the fourth clock signal (CKVB2).

Driving voltage input ends (Voff') of the plurality of second gate driving blocks (220-1, 220-2, 220-3, and 220-4) may receive the first driving voltage (VSS). The first driving voltage (VSS) may be a gate-off voltage.

Output ends (OUT') of the plurality of second gate driving blocks (220-1, 220-2, 220-3, and 220-4) are connected to a plurality of second gate lines (Gy1, Gy2, Gy3, and Gy4), respectively.

Figure 8:
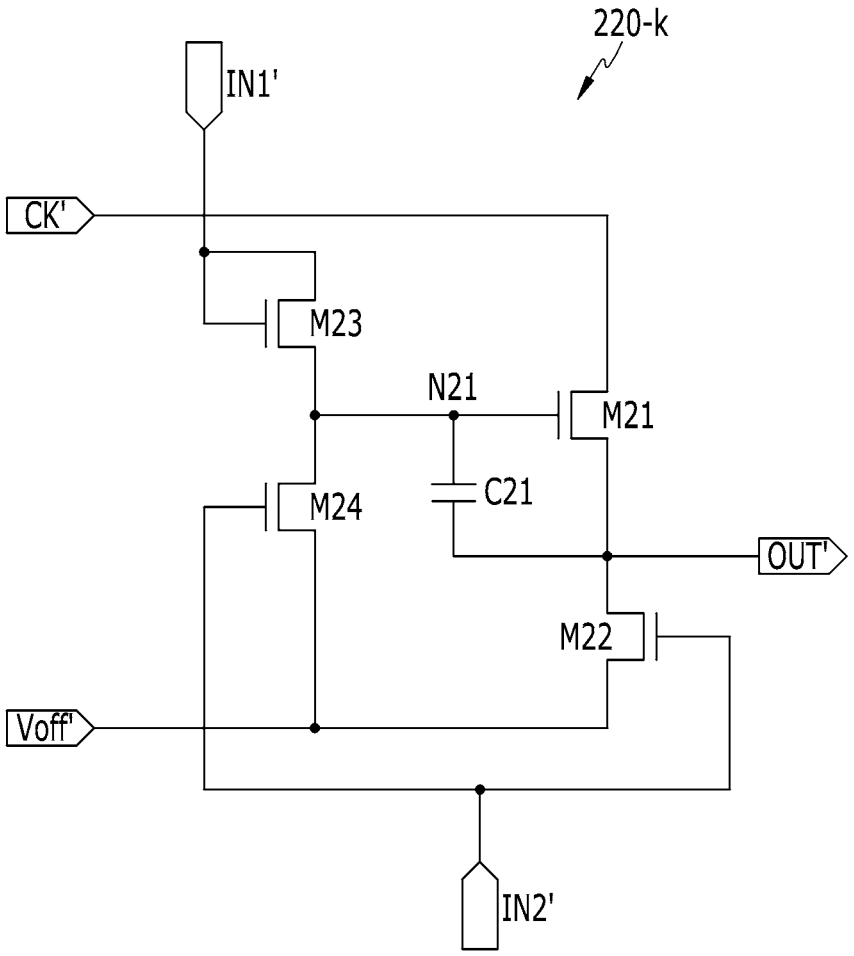
FIG. 8 shows a circuit diagram of a second gate driving block included in a second gate driver according to an embodiment.

FIG. 8 shows a circuit diagram of a second gate driving block included in a second gate driver of FIG. 7. The circuit diagram of FIG. 8 indicates one second gate driving block 220-*k* of a plurality of second gate driving blocks.

Referring to FIG. 8, the second gate driving block 220-*k* includes a first transistor M21, a second transistor M22, a third transistor M23, a fourth transistor M24, and a first capacitor C21.

The first transistor M21 includes a gate electrode connected to the first node N21, a first electrode connected to the clock signal input end (CK'), and a second electrode connected to the output end (OUT').

The second transistor M22 includes a gate electrode connected to the second input end (IN2'), a first electrode connected to the driving voltage input end (Voff'), and a second electrode connected to the output end (OUT').

The third transistor M23 includes a gate electrode connected to the first input end (IN1'), a first electrode connected to the first input end (IN1'), and a second electrode connected to the first node N21.

The fourth transistor M24 includes a gate electrode connected to the second input end (IN2'), a first electrode connected to the driving voltage input end (Voff'), and a second electrode connected to the first node N21.

The first transistor M21, the second transistor M22, the third transistor M23, and the fourth transistor M24 may be N-channel electric field effect transistors. In an embodiment, the first transistor M21, the second transistor M22, the third transistor M23, and the fourth transistor M24 may be P-channel electric field effect transistors.

The first capacitor C21 includes a first electrode connected to the first node N21 and a second electrode connected to the output end (OUT').

When the first input end (IN1') receives the second gate start signal STV2 or the gate signal (Sy[k−1]) with a gate-on voltage, the third transistor M23 is turned on and the gate-on voltage is transmitted to the first node N21. By the gate-on voltage at the first node N21, the first transistor M21 is turned on, and the clock signal input to the clock signal input end (CK') is output to the output end (OUT') as the second gate signal (Sy[k]) with a gate-on voltage. The first capacitor C21 may store the gate-on voltage at the first node N21 to maintain the turn-on state of the first transistor M21. In this instance, the second input end (IN2') receives a gate-off voltage to turn off the second transistor M22 and the fourth transistor M24.

When the output end (OUT') outputs the second gate signal (Sy[k]), and the second input end (IN2') receives the second gate signal (Sy[k+1]) with a gate-on voltage, the second transistor M22 and the fourth transistor M24 are turned on, and the first driving voltage (VSS) with a gate-off voltage is transmitted to the output end (OUT') and the first node N21. The output end (OUT) outputs the second gate signal (Sy[k]) with a gate-off voltage. The first transistor M21 is turned off by the gate-off voltage at the first node N21.

A method for a display device described with reference to FIG. 1 to FIG. 8 to apply a data signal to a plurality of pixels PX through a data line (DL) is described with reference to FIG. 9.

Figure 9:
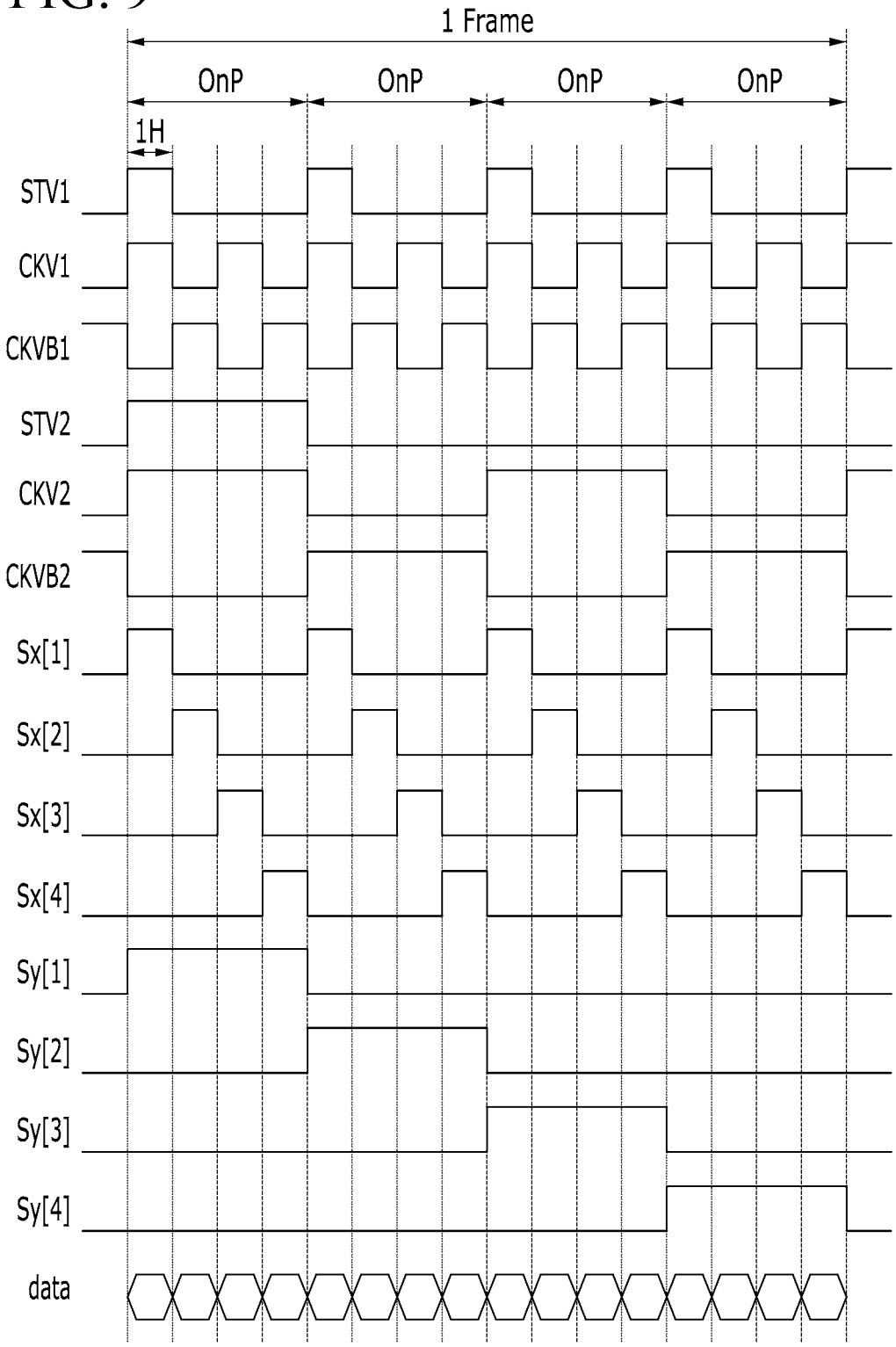
FIG. 9 shows a timing diagram of a method for driving a display device according to an embodiment.

FIG. 9 shows a timing diagram of a method for driving a display device of FIG. 1 according to an embodiment.

Referring to FIG. 9, the first clock signal (CKV1) and the second clock signal (CKVB1) may be clock signals with levels that are changeable to a gate-on voltage and a gate-off voltage for each one horizontal period 1H. In this instance, the phases of the first clock signal (CKV1) and the second clock signal (CKVB1) may be opposite. The one horizontal period 1H may be the same as one period of the horizontal synchronizing signal Hsync.

The third clock signal (CKV2) and the fourth clock signal (CKVB2) may be clock signals with levels that are changeable to a gate-on voltage and a gate-off voltage for each gate-on period (OnP). In this instance, the phases of the third clock signal CKV2 and the fourth clock signal (CKVB2) may be opposite.

The gate-on period (OnP) may be established to be a period in which the first gate signals (Sx[1], Sx[2], Sx[3], and Sx[4]) with a gate-on voltage are output once to a plurality of first gate lines (Gx1, Gx2, Gx3, and Gx4). A plurality of second gate driving blocks (220-1, 220-2, 220-3, and 220-4) may sequentially output the second gate signals (Sy[1], Sy[2], Sy[3], and Sy[4]) with a gate-on voltage, respectively, during the gate-on period (OnP).

The display device 10 illustrated in FIG. 1 includes four first gate lines (Gx1, Gx2, Gx3, and Gx4), and the first gate signals (Sx[1], Sx[2], Sx[3], and Sx[4]) having a gate-on voltage for one horizontal period are applied to the four first gate lines (Gx1, Gx2, Gx3, and Gx4), respectively, so the gate-on period (OnP) becomes four horizontal periods.

The periods of the first clock signal CKV1 and the second clock signal (CKVB1) may become two horizontal periods, and the periods of the third clock signal CKV2 and the fourth clock signal (CKVB2) may become eight horizontal periods. When the number of the first gate lines (Gx1, Gx2, Gx3, and Gx4) is set to be n, the periods of the third clock signal CKV2 and the fourth clock signal (CKVB2) become n times the periods of the first clock signal (CKV1) and the second clock signal (CKVB1).

The first gate start signal STV1 increases to be the gate-on voltage in synchronization with a starting point of the gate-on period (OnP) for each gate-on period (OnP), and it may maintain the gate-on voltage for at least one horizontal period 1H according to a duty of the gate-on voltage of the first clock signal CKV1 or the second clock signal (CKVB1).

The second gate start signal STV2 increases to be the gate-on voltage in synchronization with a starting point of one frame for each frame, and it may maintain the gate-on voltage for at least four horizontal periods according to a duty of the gate-on voltage of the third clock signal CKV2 or the fourth clock signal (CKVB2).

By the second gate start signal STV2, the third clock signal (CKV2), and the fourth clock signal (CKVB2), a plurality of second gate driving blocks (220-1, 220-2, 220-3, and 220-4) may sequentially output the second gate signals (Sy[1], Sy[2], Sy[3], and Sy[4]) having a gate-on voltage for each gate-on period (OnP) unit during one frame.

By the first gate start signal STV1, the first clock signal (CKV1), and the second clock signal (CKVB1), a plurality of first gate driving blocks (210-1, 210-2, 210-3, and 210-4) may sequentially output the first gate signals (Sx[1], Sx[2], Sx[3], and Sx[4]) each having a gate-on voltage for consecutive horizontal period 1H units for each gate-on period (OnP).

The data signal (data) is applied to the data line (DL) in synchronization with a plurality of first gate signals (Sx[1], Sx[2], Sx[3], and Sx[4]) with a gate-on voltage. The data signal (data) may be transmitted to the liquid crystal capacitor Clc through the first switching transistor M1 and the second switching transistor M2 of the pixel PX turned on by the first gate signals (Sx[1], Sx[2], Sx[3], and Sx[4]) with a gate-on voltage and the second gate signals (Sy[1], Sy[2], Sy[3], and Sy[4]) with a gate-on voltage.

Figure 10:
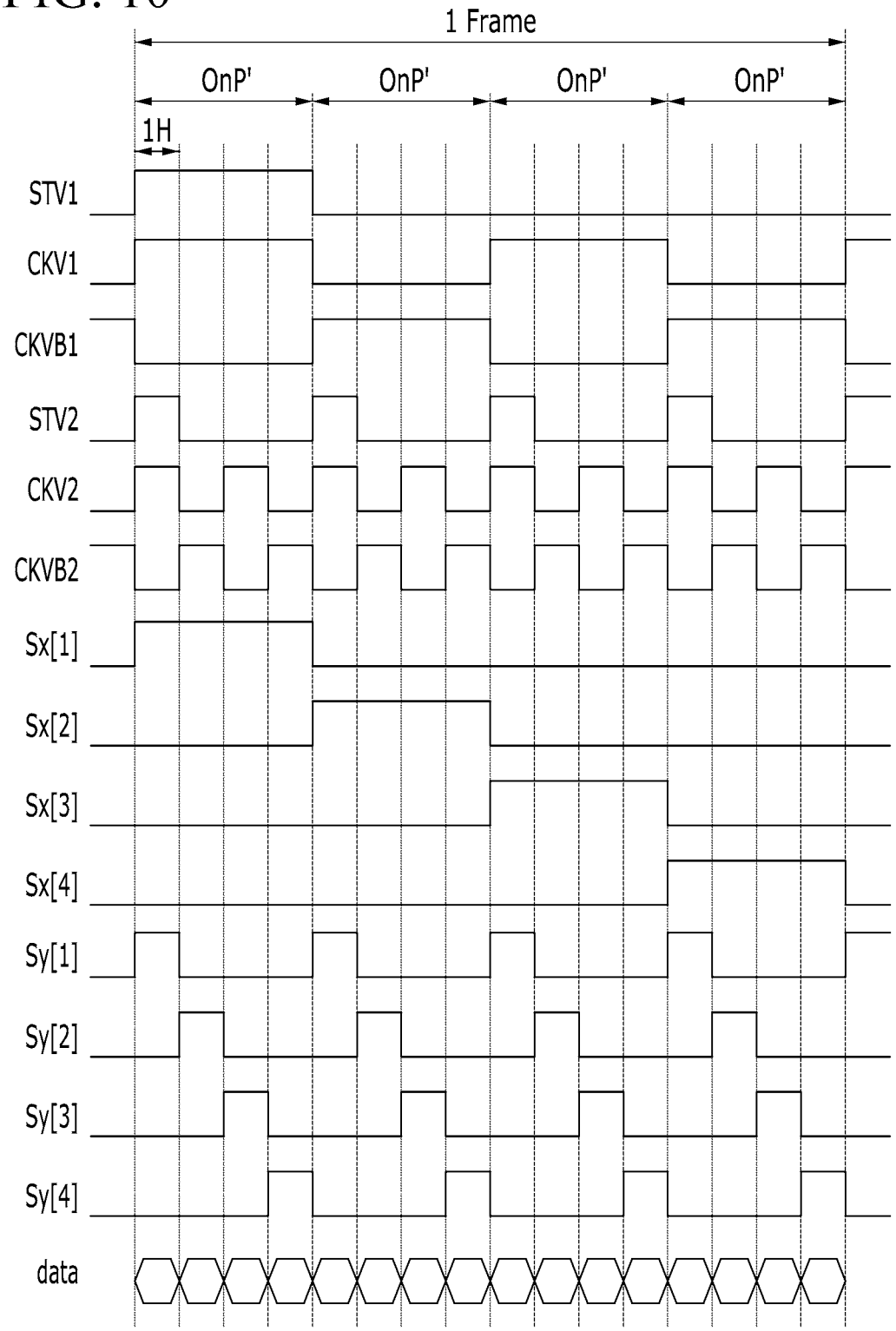
FIG. 10 shows a timing diagram of a method for driving a display device according to an embodiment.

FIG. 10 shows a timing diagram of a method for driving a display device of FIG. 1 according to an embodiment.

Referring to FIG. 10, the third clock signal (CKV2) and the fourth clock signal (CKVB2) may be clock signals with levels that are changeable to a gate-on voltage and a gate-off voltage for each one horizontal period 1H. In this instance, the phases of the third clock signal CKV2 and the fourth clock signal (CKVB2) may be opposite.

The first clock signal (CKV1) and the second clock signal (CKVB1) may be clock signals with levels that are changeable to a gate-on voltage and a gate-off voltage for each gate-on period (OnP'). In this instance, the phases of the first clock signal CKV1 and the second clock signal (CKVB1) may be opposite.

The gate-on period (OnP') may be established to be a period in which the second gate signals (Sy[1], Sy[2], Sy[3], and Sy[4]) with a gate-on voltage are output once to a plurality of second gate lines (Gy1, Gy2, Gy3, and Gy4). A plurality of first gate driving blocks (210-1, 210-2, 210-3, and 210-4) may sequentially output the first gate signals (Sx[1], Sx[2], Sx[3], and Sx[4]) having a gate-on voltage during the gate-on period (OnP').

The display device 10 illustrated in FIG. 1 includes four second gate lines (Gy1, Gy2, Gy3, and Gy4), and the second gate signals (Sy[1], Sy[2], Sy[3], and Sy[4]) having a gate-on voltage for one horizontal period are applied to the four second gate lines (Gy1, Gy2, Gy3, and Gy4), respectively, so the gate-on period (OnP') becomes four horizontal periods.

The periods of the first clock signal (CKV1) and the second clock signal (CKVB1) may become eight horizontal periods, and the periods of the third clock signal CKV2 and the fourth clock signal (CKVB2) may become two horizontal periods. When the number of the second gate lines (Gy1, Gy2, Gy3, and Gy4) is set to be m, the periods of the first clock signal (CKV1) and the second clock signal (CKVB1) become m times the periods of the third clock signal (CKV2) and the fourth clock signal (CKVB2).

The first gate start signal STV1 increases to be the gate-on voltage in synchronization with a starting point of one frame for each frame, and it may maintain the gate-on voltage for at least four horizontal periods according to a duty of the gate-on voltage of the first clock signal CKV1 or the second clock signal (CKVB1).

The second gate start signal STV2 increases to be the gate-on voltage in synchronization with a starting point of the gate-on period (OnP') for each gate-on period (OnP'), and it may maintain the gate-on voltage for at least one horizontal period 1H according to a duty of the gate-on voltage of the third clock signal (CKV2) or the fourth clock signal (CKVB2).

By the first gate start signal STV1, the first clock signal CKV1, and the second clock signal (CKVB1), a plurality of first gate driving blocks (210-1, 210-2, 210-3, and 210-4) may sequentially output the first gate signals (Sx[1], Sx[2], Sx[3], and Sx[4]) having a gate-on voltage for each gate-on period (OnP') for one frame.

By the second gate start signal STV2, the third clock signal CKV2, and the fourth clock signal (CKVB2), a plurality of second gate driving blocks (220-1, 220-2, 220-3, and 220-4) may sequentially output the second gate signals (Sy[1], Sy[2], Sy[3], and Sy[4]) each having a gate-on voltage for corresponding horizontal period 1H units for each gate-on period (OnP').

The data signal (data) is applied to the data line (DL) in synchronization with a plurality of second gate signals (Sy[1], Sy[2], Sy[3], and Sy[4]) with a gate-on voltage. The data signal (data) may be transmitted to the liquid crystal capacitor Clc through the first switching transistor M1 and the second switching transistor M2 of the pixel PX turned on by the first gate signals (Sx[1], Sx[2], Sx[3], and Sx[4]) with a gate-on voltage and the second gate signals (Sy[1], Sy[2], Sy[3], and Sy[4]) with a gate-on voltage.

As described above, a plurality of pixels PX arranged in a matrix form are connected to one data line (DL), and the data signal (data) may be applied to a plurality of pixels PX through the one data line (DL). Therefore, when the data driver 300 and the display unit 600 are connected with a flexible circuit board, one data line (DL) may be connected to the display unit 600 through the flexible circuit board, thereby reducing the width of the flexible circuit board.

A display device according to an embodiment is described with reference to FIG. 11.

Figure 11:
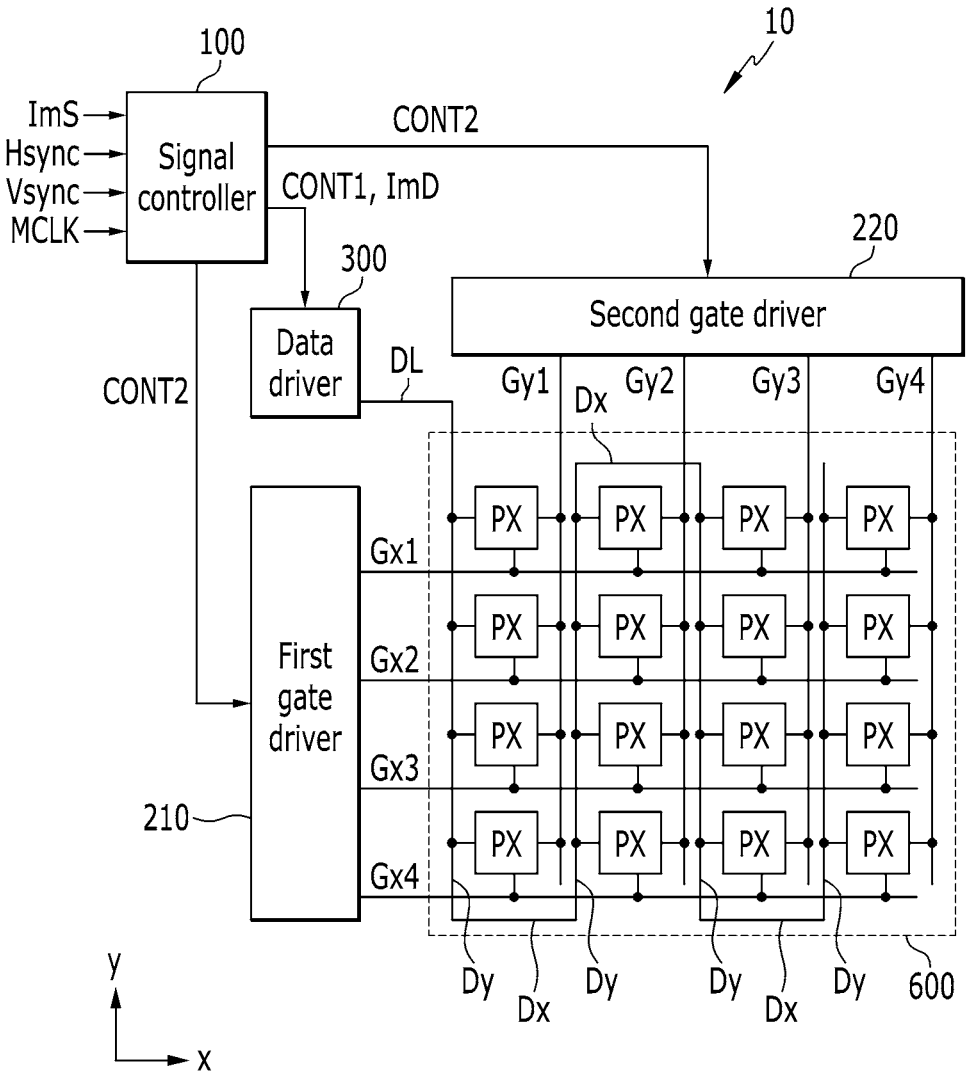
FIG. 11 shows a block diagram of a display device according to an embodiment.

FIG. 11 shows a block diagram of a display device according to an embodiment.

Referring to FIG. 11, a second sub-data line (Dy) extends in the second direction (y) along one pixel column, a first sub-data line (Dx) extends to the next pixel column in the first direction (x) from an end of the second sub-data line (Dy). In this manner, the first sub-data line (Dx) may be alternately arranged at ends of pixel columns, and pixels PX in a same pixel column may be connected in common to a same second sub-data lines (Dy).

Except for the above-noted differences, characteristics of an embodiment described with reference to FIG. 1 to FIG. 10 may be applicable to an embodiment described with reference to FIG. 11.

A pixel according to an embodiment is described with reference to FIG. 12 to FIG. 14.

Figure 12:
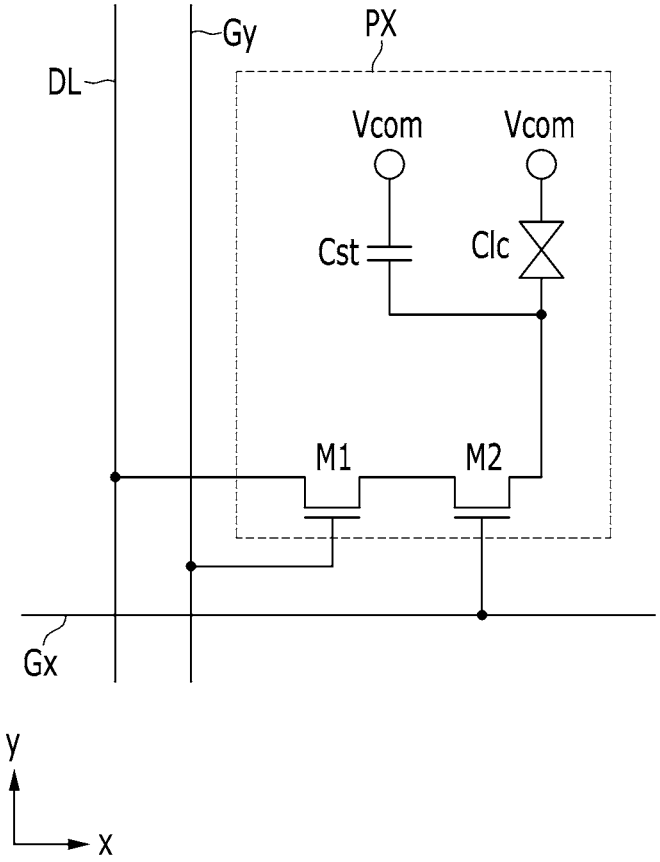
FIG. 12 shows a circuit diagram of a pixel according to an embodiment.

FIG. 12 shows a circuit diagram of a pixel according to an embodiment.

Referring to FIG. 12, the pixel PX includes a first switching transistor M1, a second switching transistor M2, a liquid crystal capacitor Clc, and a storage capacitor Cst.

The first switching transistor M1 includes a gate electrode connected to the second gate line (Gy), a first electrode connected to the data line (DL), and a second electrode connected to the second switching transistor M2. The first switching transistor M1 is turned on by the second gate signal with a gate-on voltage applied to the second gate line (Gy) to transmit the data signal applied to the data line (DL) to the second switching transistor M2.

The second switching transistor M2 includes a gate electrode connected to the first gate line (Gx), a first electrode connected to the first switching transistor M1, and a second electrode connected to the liquid crystal capacitor Clc. The second switching transistor M2 is turned on by the first gate signal with a gate-on voltage applied to the first gate line (Gx) to transmit the data signal transmitted through the first switching transistor M1 to the liquid crystal capacitor Clc.

Except for the above-noted differences, characteristics of an embodiment described with reference to FIG. 2 may be applicable to an embodiment described with reference to FIG. 12.

Figure 13:
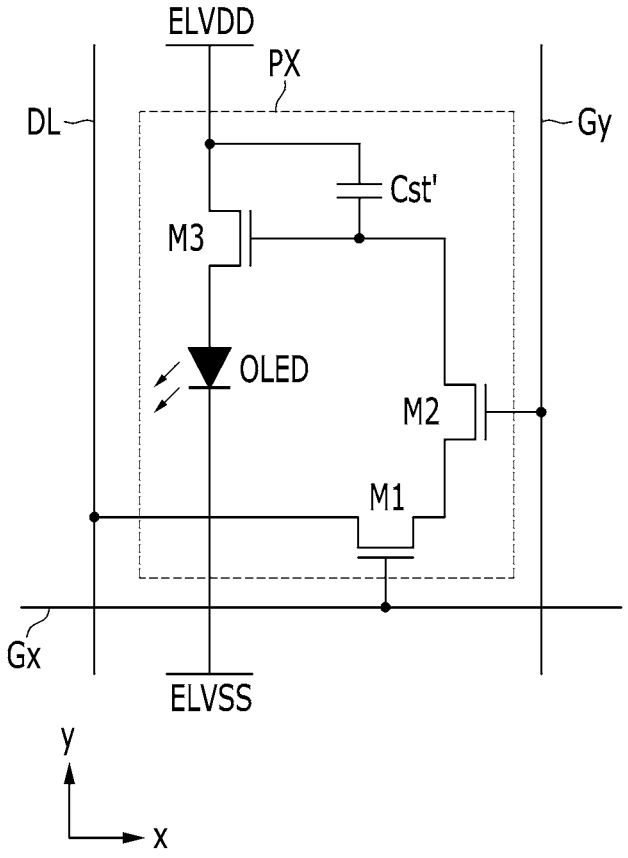
FIG. 13 shows a circuit diagram of a pixel according to an embodiment.

FIG. 13 shows a circuit diagram of a pixel according to an embodiment.

Referring to FIG. 13, the pixel PX includes a first switching transistor M1, a second switching transistor M2, a driving transistor M3, a storage capacitor (Cst'), and a light emitting diode (OLED).

The first switching transistor M1 includes a gate electrode connected to the first gate line (Gx), a first electrode connected to the data line (DL), and a second electrode connected to the second switching transistor M2. The first switching transistor M1 is turned on by the first gate signal with a gate-on voltage applied to the first gate line (Gx) to transmit the data signal transmitted through the data line (DL) to the second switching transistor M2.

The second switching transistor M2 includes a gate electrode connected to the second gate line (Gy), a first electrode connected to the first switching transistor M1, and a second electrode connected to the driving transistor M3. The second switching transistor M2 is turned on by the second gate signal with a gate-on voltage applied to the second gate line (Gy) to transmit the data signal transmitted through the first switching transistor M1 to the driving transistor M3.

The driving transistor M3 includes a gate electrode connected to the second switching transistor M2, a first electrode connected to a first power voltage (ELVDD), and a second electrode connected to the light emitting diode (OLED). The driving transistor M3 transmits a current corresponding to the data signal transmitted through the second switching transistor M2 to the light emitting diode (OLED) from the first power voltage (ELVDD). The driving transistor M3 may be an N-channel electric field effect transistor. In an embodiment, the driving transistor M3 may be a P-channel electric field effect transistor.

The storage capacitor (Cst') includes a first electrode connected to a gate electrode of the driving transistor M3 and a second electrode connected to the first power voltage (ELVDD).

The light emitting diode (OLED) includes an anode connected to the driving transistor M3 and a cathode connected to the second power voltage (ELVSS). The light emitting diode (OLED) may emit light of one of primary colors by the current transmitted from the driving transistor M3. The light emitting diode (OLED) may be an organic light emitting diode including an emission layer of an organic compound. In an embodiment, the light emitting diode (OLED) may be an inorganic light emitting diode (LED) including an emission layer of an inorganic compound.

Figure 14:
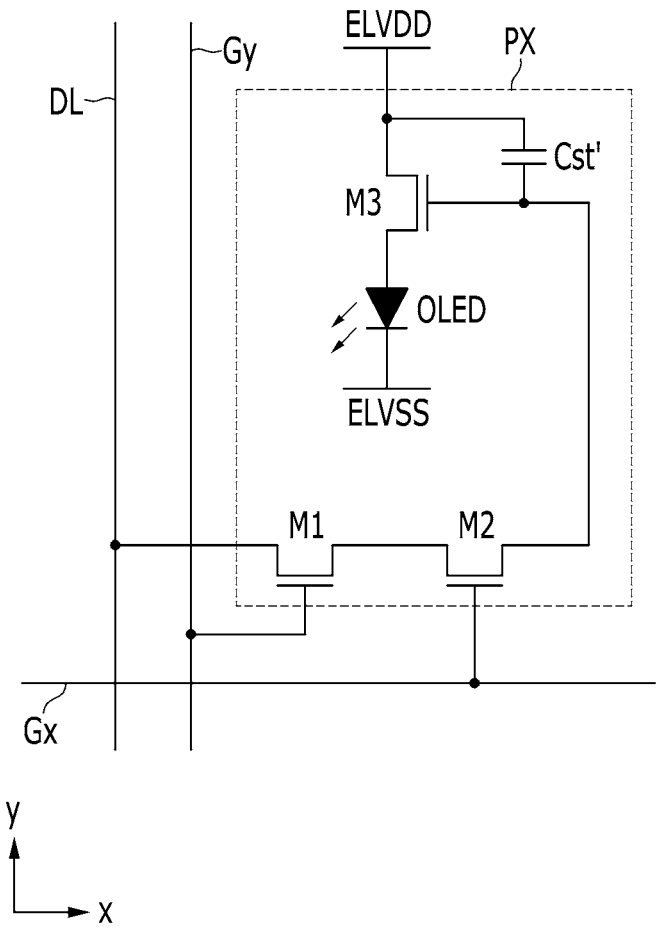
FIG. 14 shows a circuit diagram of a pixel according to an embodiment.

FIG. 14 shows a circuit diagram of a pixel according to an embodiment.

Referring to FIG. 14, the pixel PX includes a first switching transistor M1, a second switching transistor M2, a driving transistor M3, a storage capacitor (Cst'), and a light emitting diode (OLED).

The first switching transistor M1 includes a gate electrode connected to the second gate line (Gy), a first electrode connected to the data line (DL), and a second electrode connected to the second switching transistor M2. The first switching transistor M1 is turned on by the second gate signal with a gate-on voltage applied to the second gate line (Gy) to transmit the data signal transmitted through the data line (DL) to the second switching transistor M2.

The second switching transistor M2 includes a gate electrode connected to the first gate line (Gx), a first electrode connected to the first switching transistor M1, and a second electrode connected to the driving transistor M3. The second switching transistor M2 is turned on by the first gate signal with a gate-on voltage applied to the first gate line (Gx) to transmit the data signal transmitted through the first switching transistor M1 to the driving transistor M3.

Except for the above-noted differences, characteristics of an embodiment described with reference to FIG. 13 may be applicable to an embodiment described with reference to FIG. 14.

Figure 15:
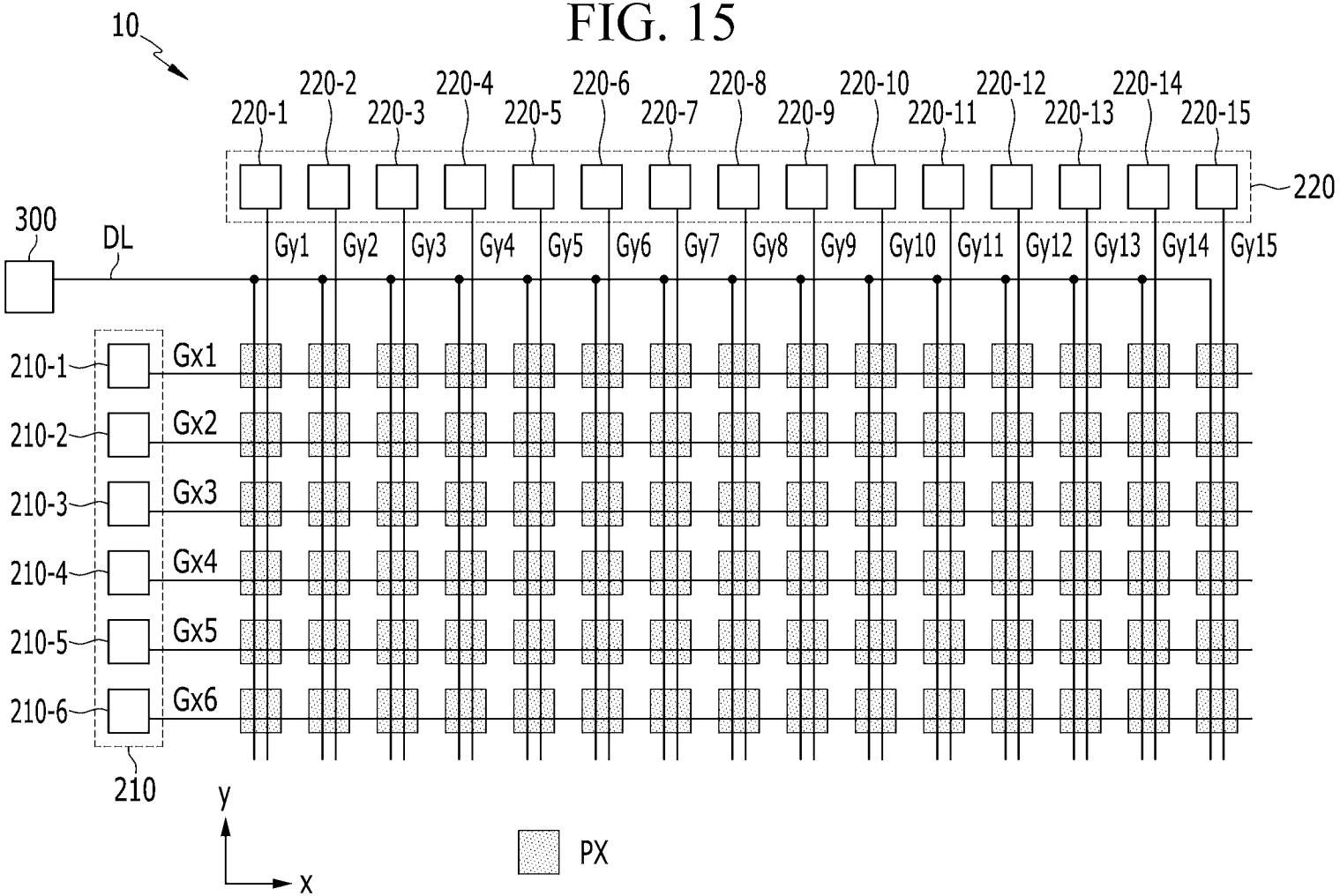
FIG. 15 shows a circuit diagram of a pixel according to an embodiment.

Various methods for driving a display device with a display device of FIG. 15 as an example, and an order for inputting a data signal to a plurality of pixels, is described.

FIG. 15 shows a circuit diagram of a pixel according to an embodiment.

Referring to FIG. 15, the display device 10 includes a plurality of first gate lines (Gx1 to Gx6) extending in the first direction (x), a plurality of second gate lines (Gy1 to Gy15) extending in the second direction (y), a first gate driver 210 connected to a plurality of first gate lines (Gx1 to Gx6), a second gate driver 220 connected to a plurality of second gate lines (Gy1 to Gy15), a plurality of pixels PX, and a data line (DL) connected to a plurality of pixels PX. The first gate driver 210 includes a plurality of first gate driving blocks (210-1 to 210-6) connected to a plurality of first gate lines (Gx1 to Gx6). The second gate driver 220 includes a plurality of second gate driving blocks (220-1 to 220-15) connected to a plurality of second gate lines (Gy1 to Gy15). The data line (DL) extends from the data driver 300 and is connected to each pixel of a plurality of pixels PX.

In the drawing, the respective pixels PX shown to overlap the first gate lines (Gx1 to Gx6), the second gate lines (Gy1 to Gy15), and the data line (DL) signify that the pixels PX are connected to the first gate line (Gx1 to Gx6), the second gate lines (Gy1 to Gy15), and the data line (DL).

The display device 10 of FIG. 15 may substantially correspond to the display device 10 of FIG. 1 except the number of a plurality of first gate lines (Gx1 to Gx6), the number of a plurality of second gate lines (Gy1 to Gy15), the number of a plurality of first gate driving blocks (210-1 to 210-6), the number of a plurality of second gate driving blocks (220-1 to 220-15), and the number of pixels PX.

Figure 16:
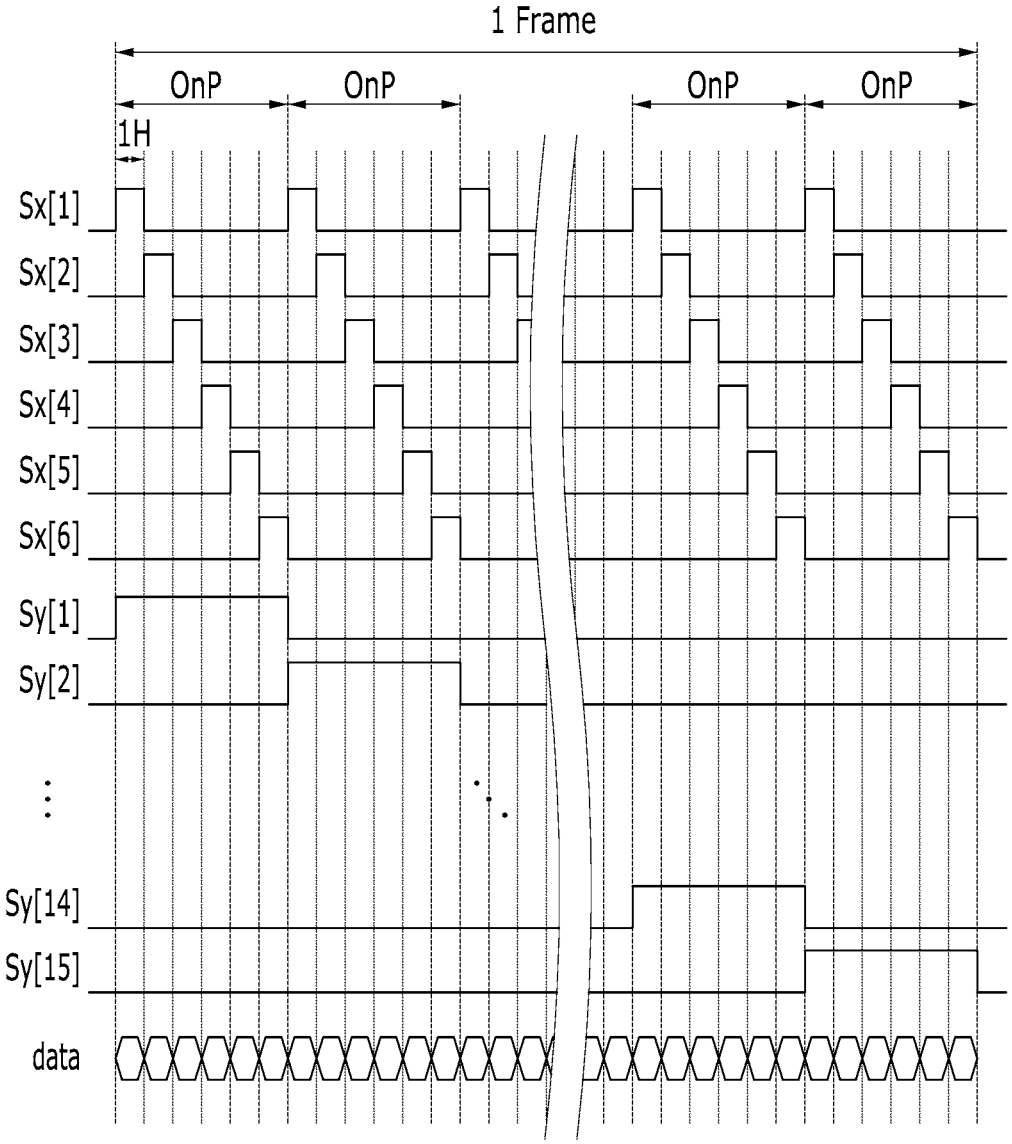
FIG. 16 shows a timing diagram of a method for driving a display device according to an embodiment.
Figure 17:
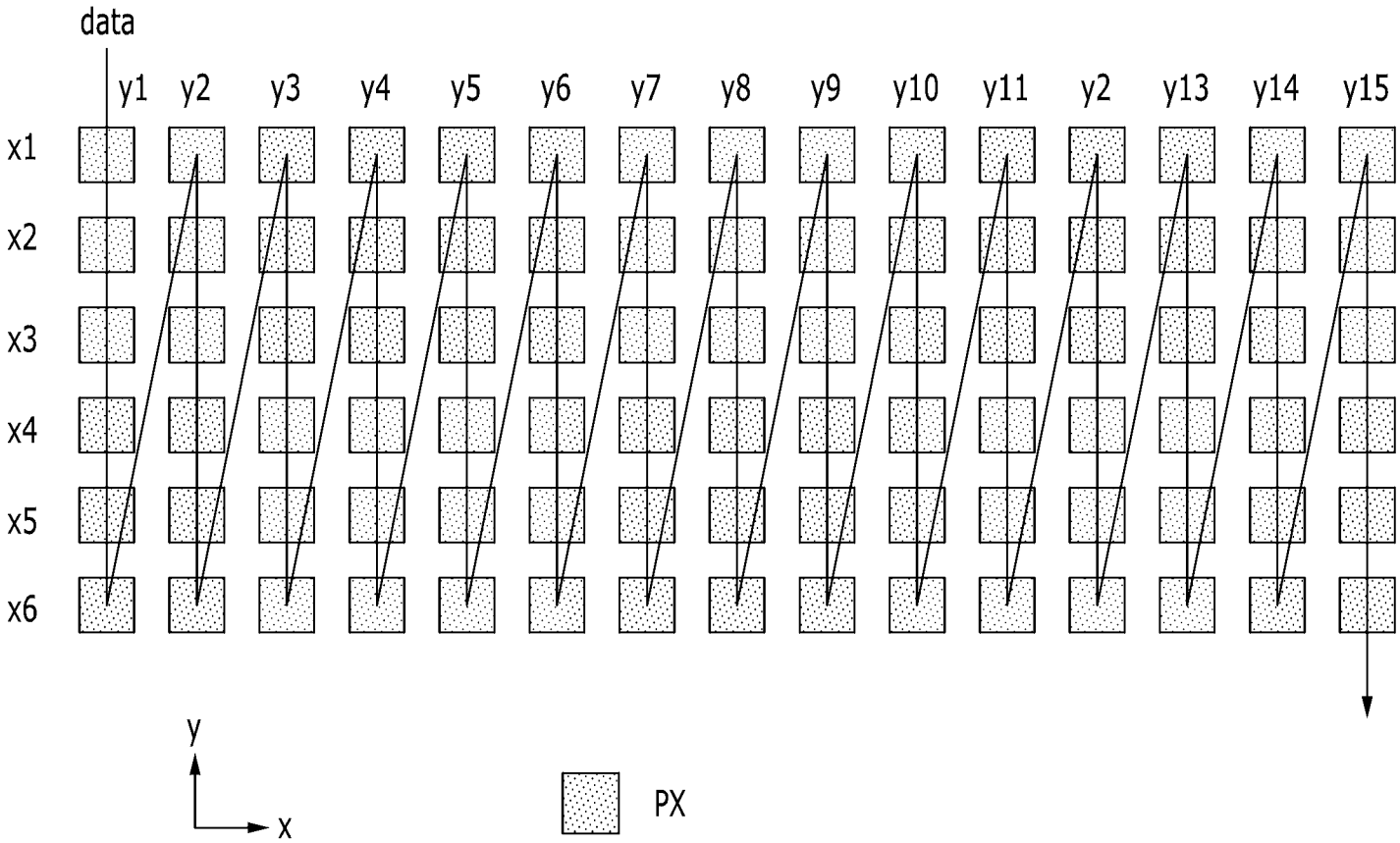
FIG. 17 shows an order for inputting a data signal to a plurality of pixels according to a method for driving a display device according to an embodiment.

FIG. 16 shows a timing diagram of a method for driving a display device of FIG. 15 according to an embodiment. FIG. 17 shows an order for inputting a data signal to a plurality of pixels according to a method for driving a display device of FIG. 16.

Referring to FIG. 16 and FIG. 17, a plurality of second gate driving blocks (220-1 to 220-15) sequentially output the second gate signals (Sy[1] to Sy[15]) with a gate-on voltage for each gate-on period (OnP) for one frame.

A plurality of first gate driving blocks (210-1 to 210-6) sequentially output the first gate signals (Sx[1] to Sx[6]) each having a gate-on voltage for consecutive horizontal periods 1H for each gate-on period (OnP). A plurality of data signals (data) are applied in synchronization with a plurality of first gate signals (Sx[1] to Sx[6]) with a gate-on voltage.

According to the method for driving a display device 10, as shown in FIG. 17, the data signal (data) may be sequentially input in a first order from a first row (x1) to a last row (x6) for each column.

In an embodiment, the first order represents an order in the column direction, that is, from top to bottom in the second direction (y). In an embodiment, the first order may indicate an order from the first gate signal (Sx[1]) applied to the first gate line Gx1 of the first row (x1) to the first gate signal (Sx[6]) applied to the first gate line Gx6 of the last row (x6).

The data signal (data) is input in the first order in the second direction (y) from the pixel PX of the first row (x1) and the first column (y1) to the pixel PX of the sixth row (x6) and the first column (y1) in the first column (y1), and the data signal (data) is then input in the first order in the second direction (y) from the pixel PX of the first row (x1) and the second column (y2) to the pixel PX of the sixth row (x6) and the second column (y2) in the second column (y2). In this manner, the data signal (data) may be input in the first order to the last column (y15). That is, the data signal (data) may be sequentially input to a plurality of pixels PX in the progressing direction of an arrow shown in FIG. 17.

Figure 18:
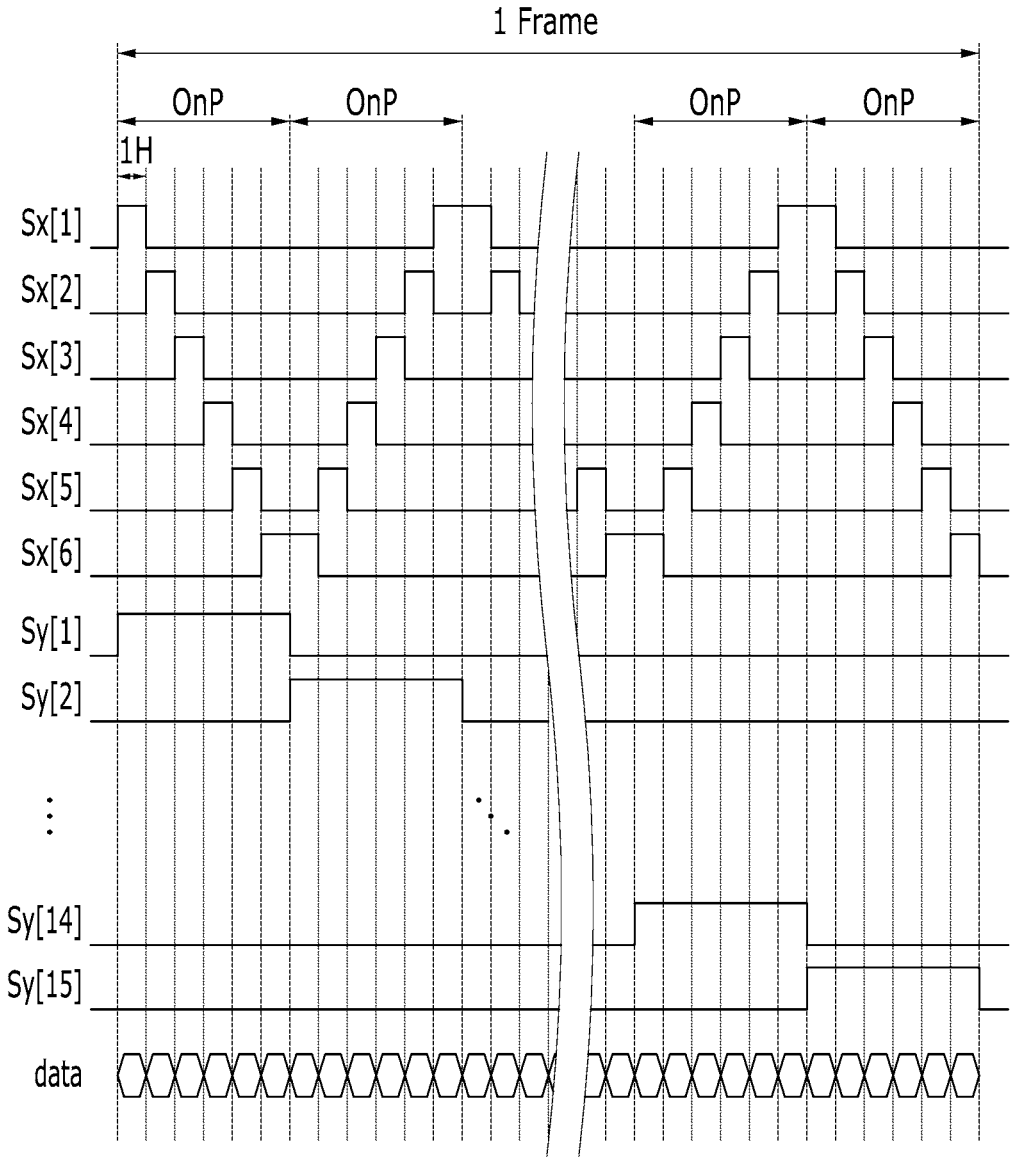
FIG. 18 shows a timing diagram of a method for driving a display device of FIG. 15 according to an embodiment.
Figure 19:
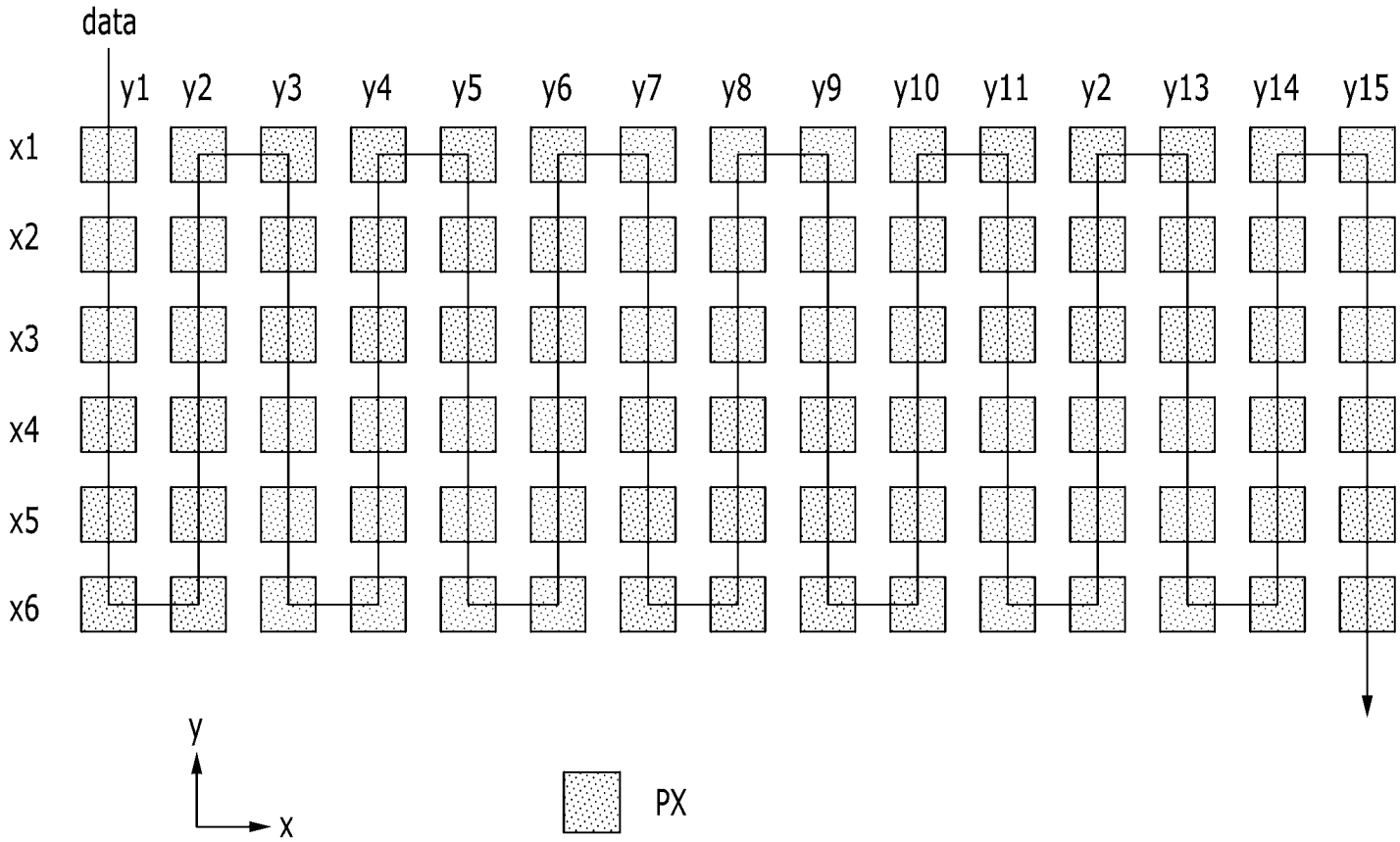
FIG. 19 shows an order for inputting a data signal to a plurality of pixels according to a method for driving a display device according to an embodiment.

FIG. 18 shows a timing diagram of a method for driving a display device of FIG. 15 according to an embodiment. FIG. 19 shows an order for inputting a data signal to a plurality of pixels according to a method for driving a display device of FIG. 18.

Referring to FIG. 18 and FIG. 19, a plurality of second gate driving blocks (220-1 to 220-15) sequentially output the second gate signals (Sy[1] to Sy[15]) with a gate-on voltage for each gate-on period (OnP) for one frame.

A plurality of first gate driving blocks (210-1 to 210-6) sequentially output the first gate signals (Sx[1] to Sx[6]) having a gate-on voltage for all consecutive horizontal periods 1H for each gate-on period (OnP), and alternate the orders for applying a plurality of first gate signals (Sx[1] to Sx[6]) to a plurality of first gate lines (Gx1 to Gx6) between the first order and the second order for consecutive gate-on periods (OnP).

The second order will hereinafter represent the column direction, that is, the order from bottom to top in the second direction (y). In an embodiment, the second order may be an order from the first gate signal (Sx[6]) applied to the first gate line Gx6 of the last row (x6) to the first gate signal (Sx[1]) applied to the first gate line Gx1 of the first row (x1). The second order is the inverse order of the first order.

The data signal (data) is applied in synchronization with a plurality of first gate signals (Sx[1] to Sx[6]) with a gate-on voltage.

According to the method for driving a display device, as shown in FIG. 19, the data signal (data) is input to the pixel PX in the first order from the first row (x1) to the last row (x6) in the odd-numbered columns (y1, y3, y5, . . . , y15), it is input to the pixel PX in the second order from the last row (x6) to the first row (x1) in the even-numbered columns (y2, y4, y6, . . . , y14), and the inputting of the data signal (data) from the first column (y1) to the last column (y15) may be performed. That is, the data signal (data) may be sequentially input to a plurality of pixels PX in the progressing direction of an arrow shown in FIG. 19.

On the other hand, the first gate driver 210 for alternately outputting a plurality of first gate signals (Sx[1] to Sx[6]) in the first order and the second order may use a bi-directional gate driving device for outputting a gate signal in the first order and the second order.

Figure 20:
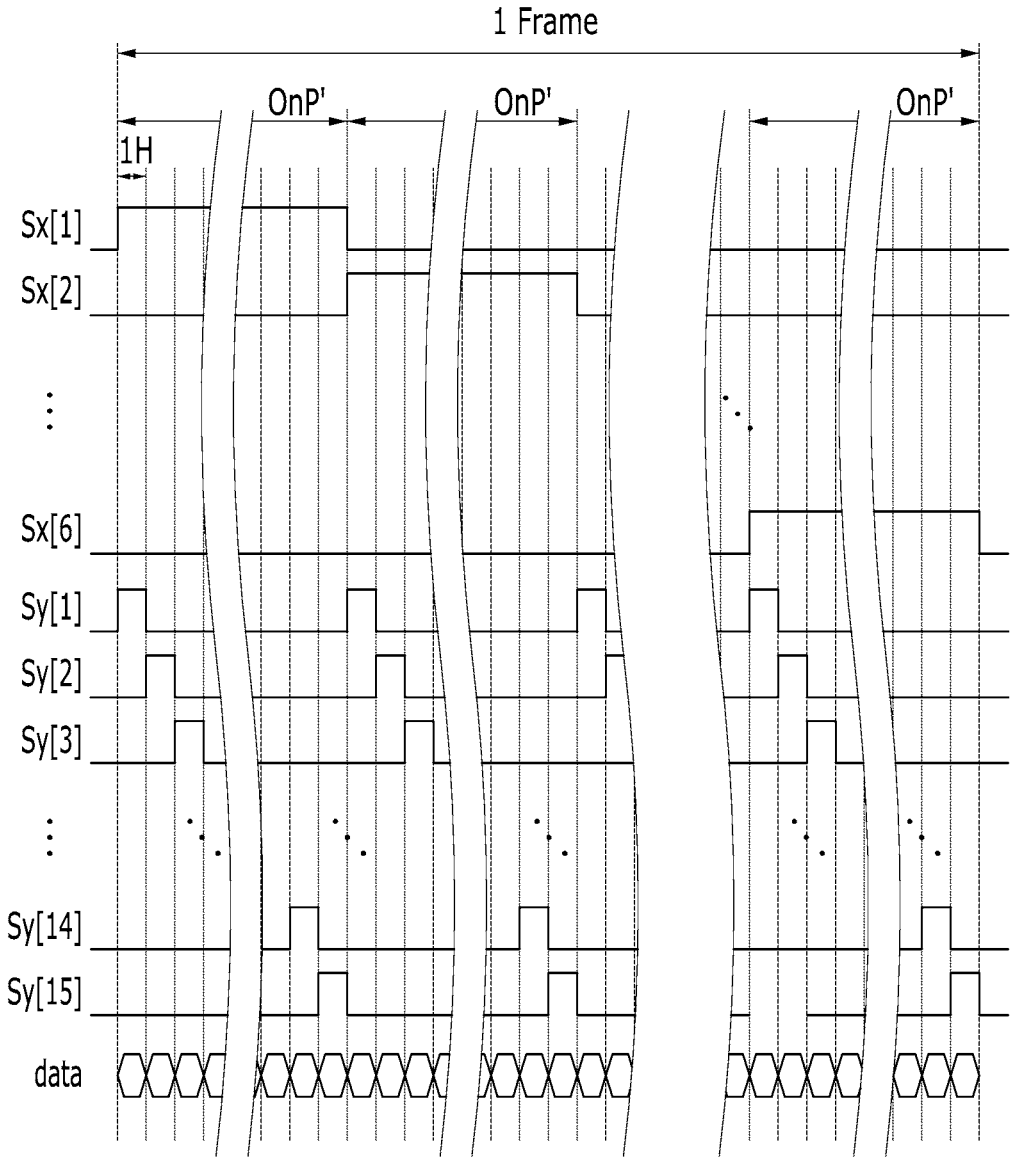
FIG. 20 shows a timing diagram of a method for driving a display device of FIG. 15 according to an embodiment.
Figure 21:
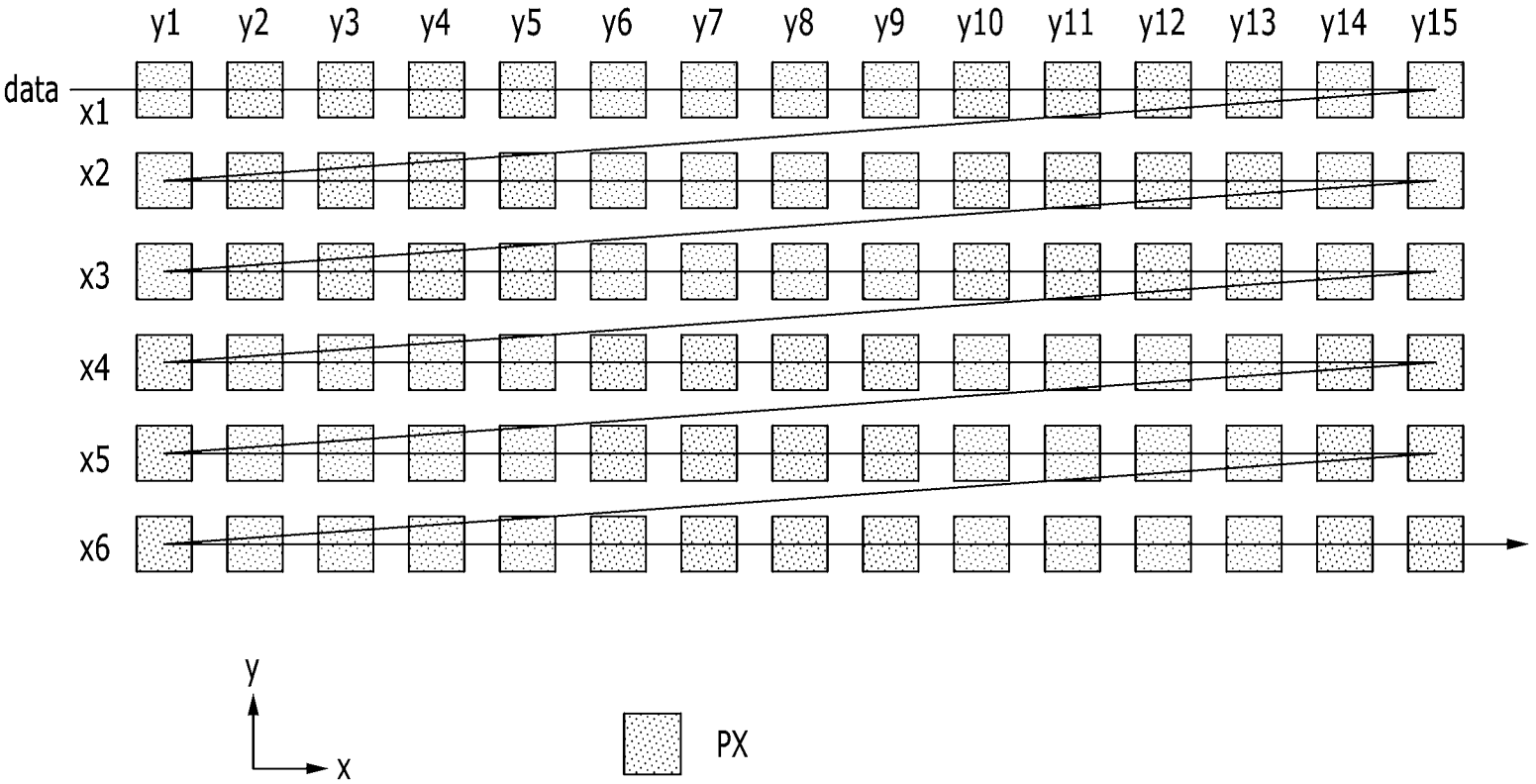
FIG. 21 shows an order for inputting a data signal to a plurality of pixels according to a method for driving a display device according to an embodiment.

FIG. 20 shows a timing diagram of a method for driving a display device of FIG. 15 according to an embodiment. FIG. 21 shows an order for inputting a data signal to a plurality of pixels according to a method for driving a display device of FIG. 20.

Referring to FIG. 20 and FIG. 21, a plurality of first gate driving blocks (210-1 to 210-6) sequentially output first gate signals (Sx[1] to Sx[6]) with a gate-on voltage for each gate-on period (OnP') for one frame.

A plurality of second gate driving blocks (220-1 to 220-15) sequentially output the second gate signals (Sy[1] to Sy[15]) each having a gate-on voltage for corresponding horizontal periods 1H for each gate-on period (OnP'). A plurality of data signals (data) are applied in synchronization with a plurality of second gate signal (Sy[1] to Sy[15]) with a gate-on voltage.

According to the method for driving a display device 10, as shown in FIG. 21, the data signal (data) may be input in a third order from the first column (y1) to the last column (y15) for each row.

Hereinafter, the third order represents an order from the left to the right in the row direction. In an embodiment, the third order may indicate an order from the second gate signal (Sy[1]) applied to the second gate line Gy1 of the first column (y1) to the second gate signal (Sy[15]) applied to the second gate line Gy15 of the last column (y15).

The data signal (data) is input in the third order in the first direction (x) from the pixel PX of the first row (x1) and the first column (y1) to the pixel PX of the first row (x1) and the fifteen column (y15) in the first row (x1), and the data signal (data) is input in the third order in the second direction (y) from the pixel PX of the second row (x2) and the first column (1y) to the pixel PX of the second row (x2) and the fifteen column (y15) in the second row (x2). In this manner, the data signal (data) may be input in the third order to the last row (x6). That is, the data signal (data) may be sequentially input to a plurality of pixels PX in the progressing direction of an arrow shown in FIG. 21.

Figure 22:
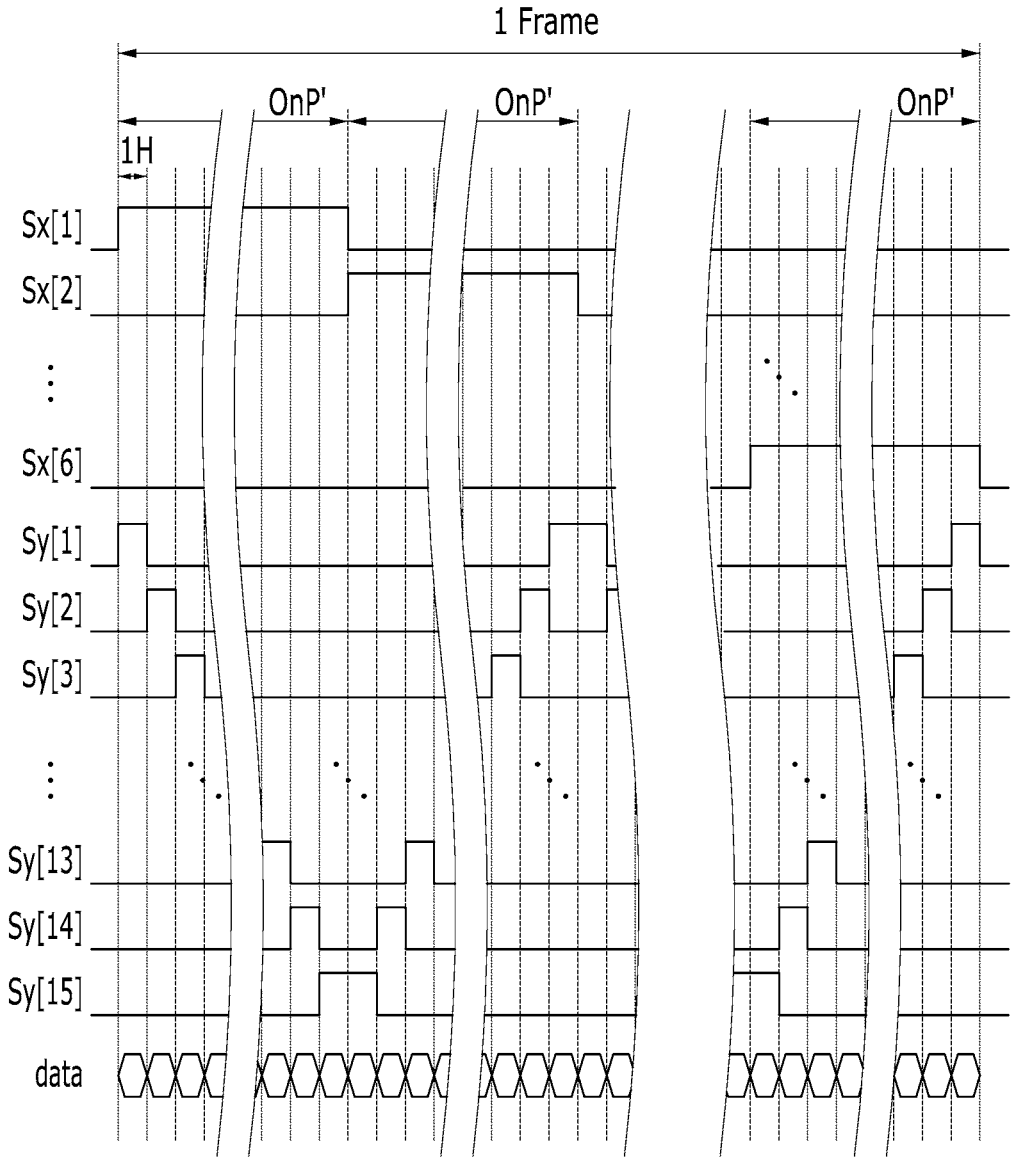
FIG. 22 shows a timing diagram of a method for driving a display device of FIG. 15 according to an embodiment.
Figure 23:
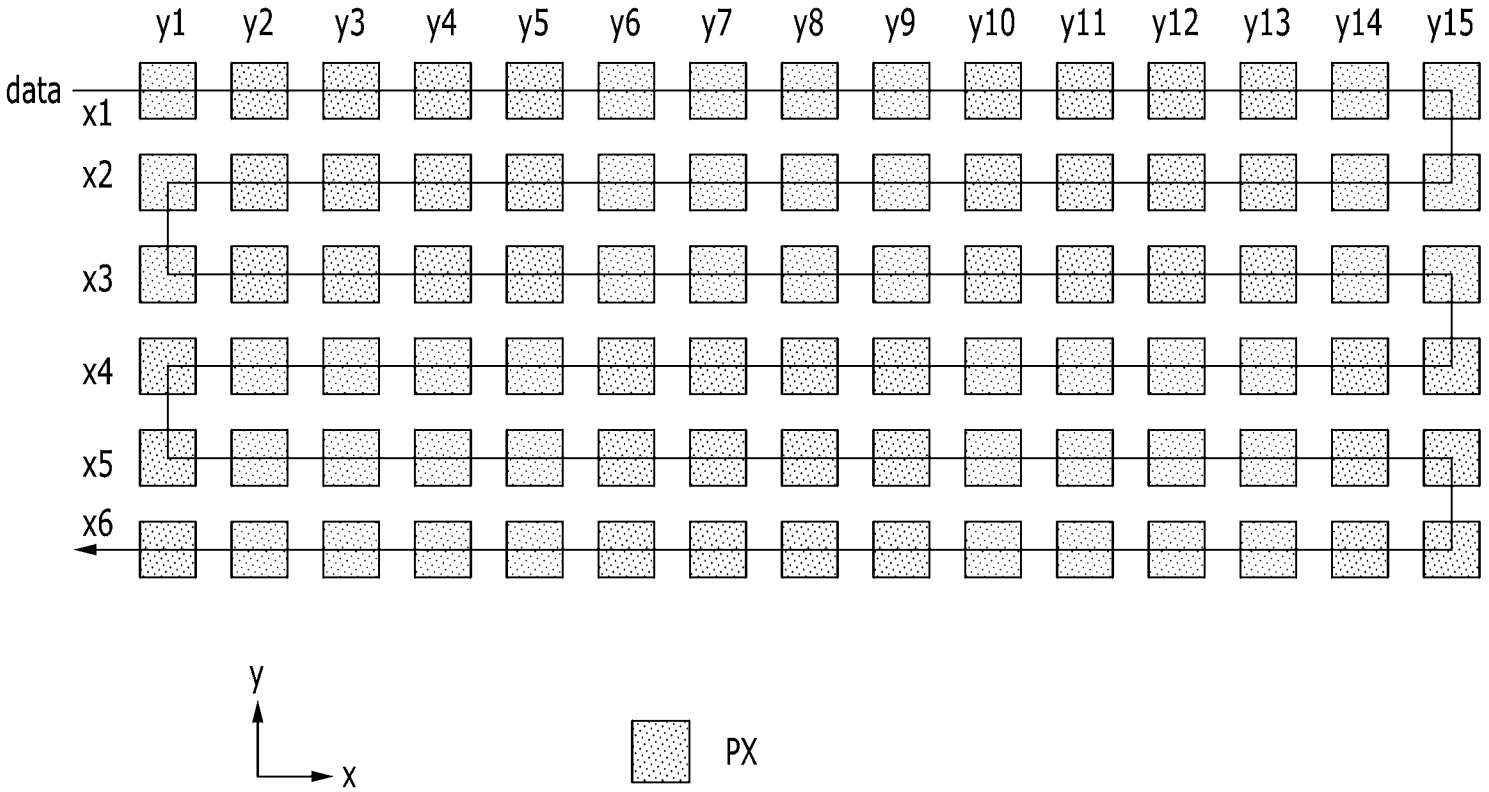
FIG. 23 shows an order for inputting a data signal to a plurality of pixels according to a method for driving a display device according to an embodiment.

FIG. 22 shows a timing diagram of a method for driving a display device of FIG. 15 according to an embodiment. FIG. 23 shows an order for inputting a data signal to a plurality of pixels according to a method for driving a display device of FIG. 15.

Referring to FIG. 22 and FIG. 23, a plurality of first gate driving blocks (210-1 to 210-6) sequentially output the first gate signals (Sx[1] to Sx[6]) with a gate-on voltage for each gate-on period (OnP') for one frame.

A plurality of second gate driving blocks (220-1 to 220-15) sequentially output the second gate signals (Sy[1] to Sy[15]) each having a gate-on voltage for consecutive horizontal periods 1H for each gate-on period (OnP'), and the order for a plurality of second gate signals (Sy[1] to Sy[15]) to be applied to a plurality of second gate lines (Gy1 to Gy15) for each gate-on period (OnP') is alternately changed between the third order and the fourth order.

In an embodiment, the fourth order represents the row direction, that is, the order from the right to the left in the first direction (x). In an embodiment, the fourth order may be an order from the second gate signal (Sy[15]) applied to the second gate line Gy15 of the last column (y15) to the second gate signal (Sy[1]) applied to the second gate line Gy1 of the first column (y1). The fourth order is an inverse order of the third order.

The data signal (data) is applied in synchronization with a plurality of second gate signals (Sy[1] to Sy[15]) with a gate-on voltage.

According to the method for driving a display device, as shown in FIG. 23, the data signal (data) is input to the pixel PX in the third order from the first column (y1) to the last column (y15) in the odd-numbered rows (x1, x3, and x5), it is input to the pixel PX in the fourth order from the last column (y15) to the first column (y1) in the even-numbered rows (x2, x4, and x6), and the inputting of the data signal (data) from the first row (x1) to the last row (x6). That is, the data signal (data) may be input to a plurality of pixels PX in the progressing direction of an arrow shown in FIG. 23.

Figure 24:
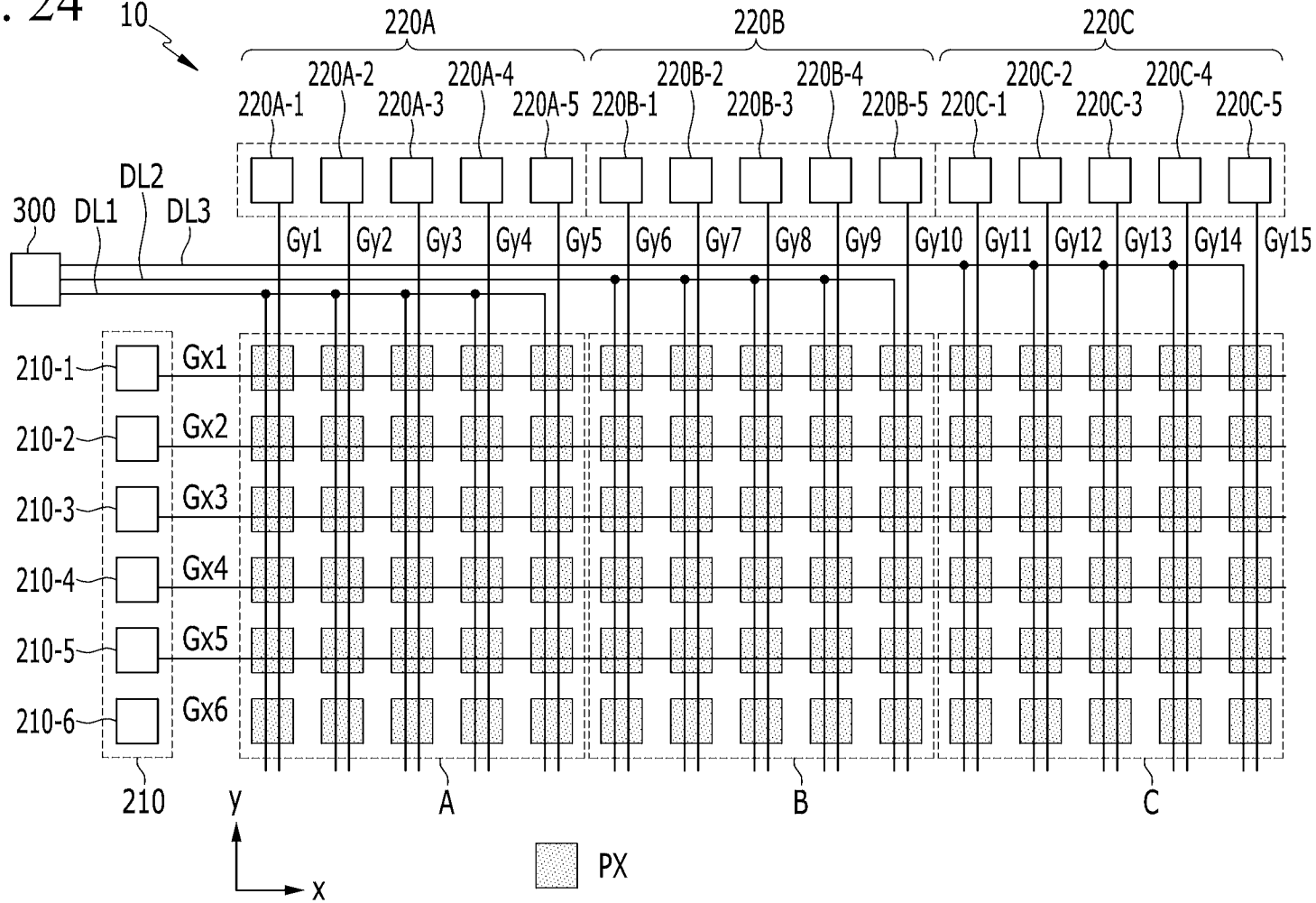
FIG. 24 shows a block diagram of a display device according to an embodiment.

A method for driving a display device with a display device of FIG. 24 as an example, and an order for inputting a data signal to a plurality of pixels, is described.

FIG. 24 shows a block diagram of a display device according to an embodiment. Differences from the display device described with reference to FIG. 15 are described.

Referring to FIG. 24, the second gate driver 220 includes a first sub-gate driver 220A, a second sub-gate driver 220B, and a third sub-gate driver 220C.

The second gate lines (Gy1 to Gy5) from among a plurality of second gate lines (Gy1 to Gy15) may be connected to the first sub-gate driver 220A, the second gate lines (Gy6 to Gy10) may be connected to the second sub-gate driver 220B, and the second gate lines (Gy11 to Gy15) may be connected to the third sub-gate driver 220C.

The first sub-gate driver 220A may include a plurality of second gate driving blocks (220A-1 to 220A-5) connected to a plurality of second gate lines (Gy1 to Gy5). The second sub-gate driver 220B may include a plurality of second gate driving blocks (220B-1 to 220B-5) connected to a plurality of second gate lines (Gy6 to Gy10). The third sub-gate driver 220C may include a plurality of second gate driving blocks (220C-1 to 220C-5) connected to the second gate lines (Gy11 to Gy15).

The data line connected to the data driver 300 may include a first data line DL1 connected to a plurality of pixels PX connected to the second gate lines (Gy1 to Gy5), a second data line DL2 connected to a plurality of pixels PX connected to the second gate lines (Gy6 to Gy10), and a third data line DL3 connected to a plurality of pixels PX connected to the second gate lines (Gy11 to Gy15).

A plurality of pixels PX connected to the first data line DL1 and the second gate lines (Gy1 to Gy5) may occupy a portion of the first region (A) in the display area. A plurality of pixels PX connected to the second data line DL2 and the second gate lines (Gy6 to Gy10) may occupy another portion of the second region (B) in the display area. A plurality of pixels PX connected to the third data line DL3 and the second gate lines (Gy11 to Gy15) may occupy the other portion of the third region (C) in the display area.

That is, the first data line DL1 may be connected to all pixels PX provided in the first region (A), the second data line DL2 may be connected to all pixels PX provided in the second region (B), and the third data line DL3 may be connected to all pixels PX provided in the third region (C). Further, the first sub-gate driver 220A may be connected to a plurality of pixels PX provided in the first region (A) through the second gate lines (Gy1 to Gy5), the second sub-gate driver 220B may be connected to a plurality of pixels PX provided in the second region (B) through the second gate lines (Gy6 to Gy10), and the third sub-gate driver 220C may be connected to a plurality of pixels PX provided in the third region (C) through the second gate lines (Gy11 to Gy15).

Except for the above-noted differences, characteristics of an embodiment described with reference to FIG. 15 are applicable to an embodiment described with reference to FIG. 24.

Figure 25:
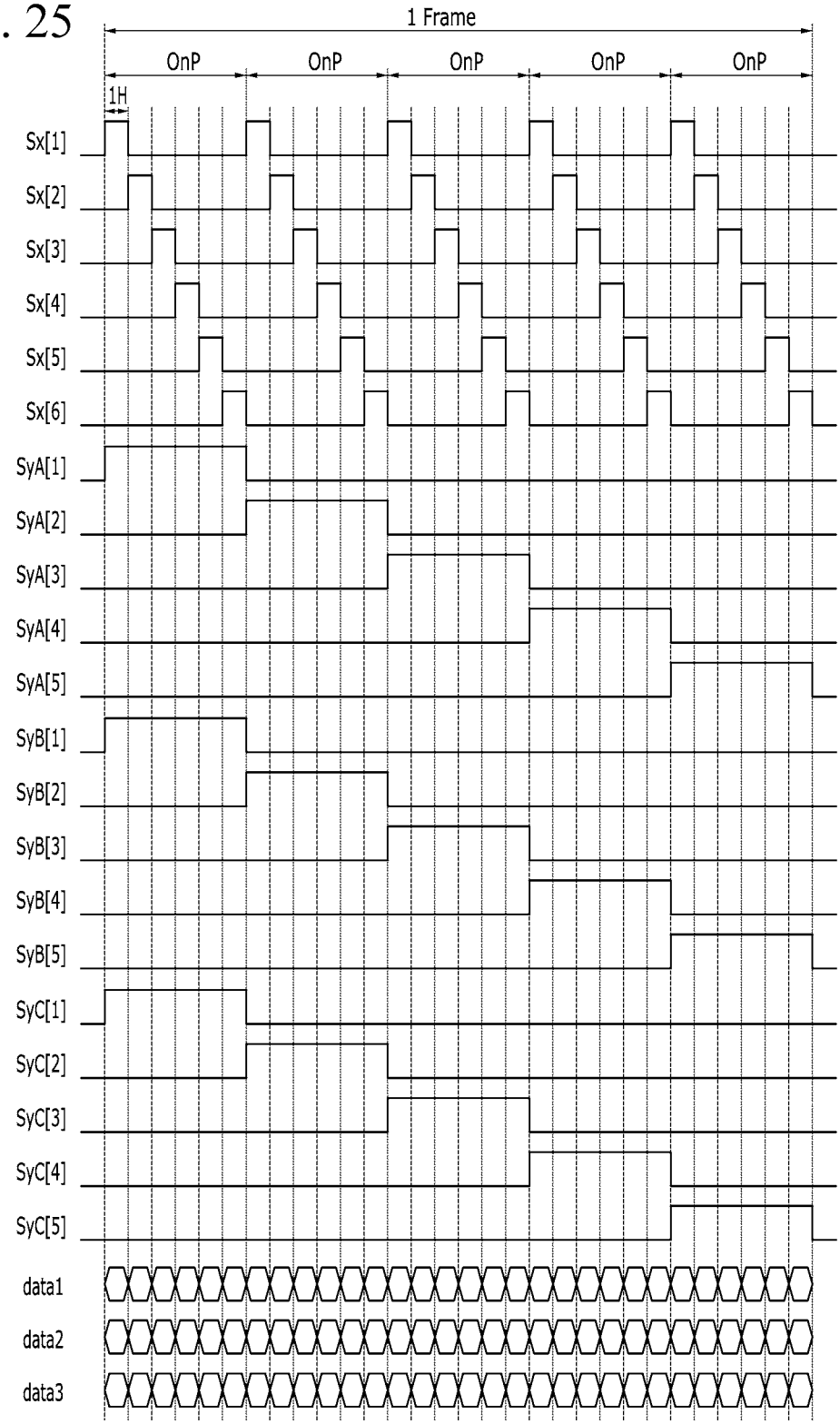
FIG. 25 shows a timing diagram of a method for driving a display device according to an embodiment.
Figure 26:
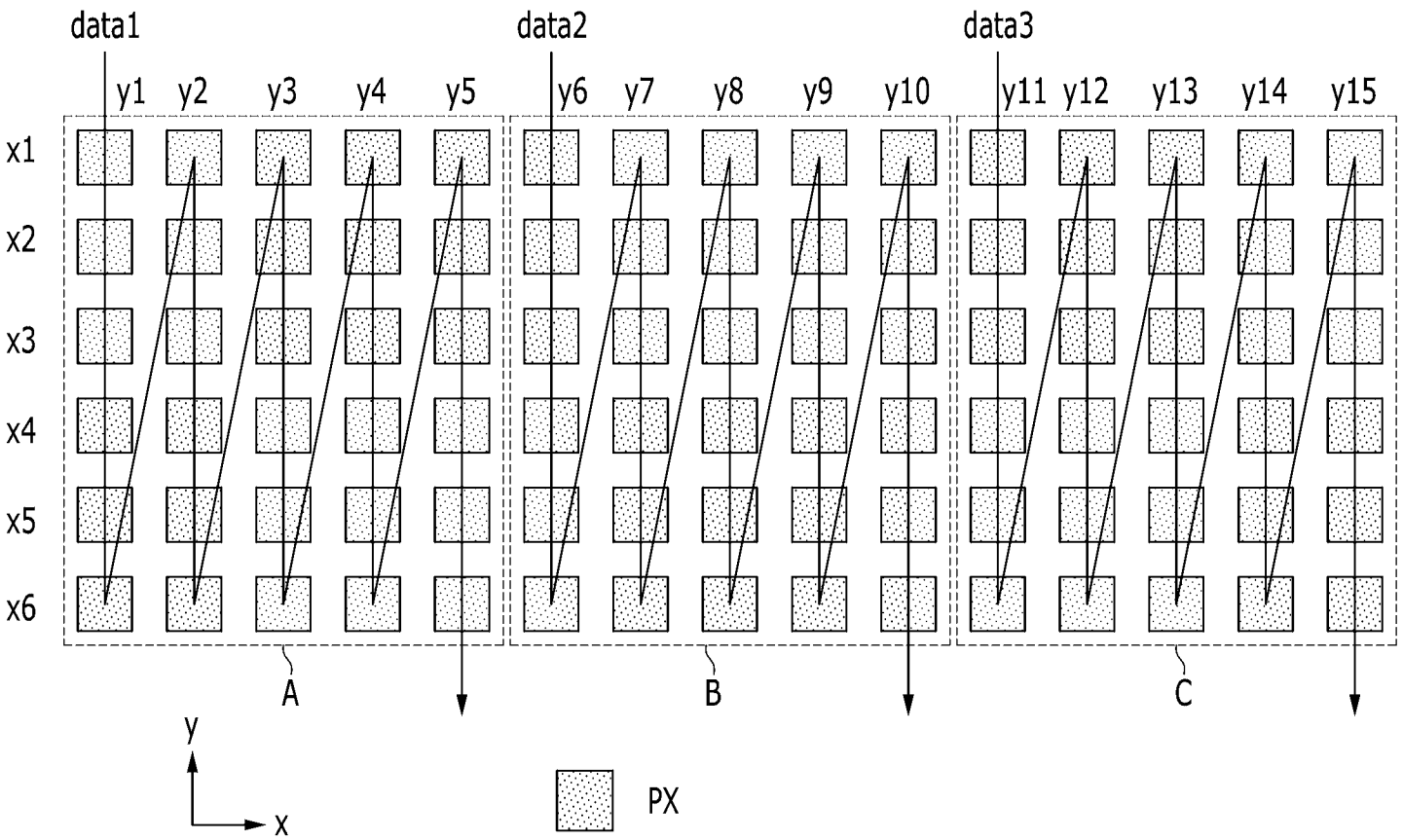
FIG. 26 shows an order for inputting a data signal to a plurality of pixels according to a method for driving a display device according to an embodiment.

FIG. 25 shows a timing diagram of a method for driving a display device of FIG. 24 according to an embodiment. FIG. 26 shows an order for inputting a data signal to a plurality of pixels according to a method for driving a display device of FIG. 25.

Referring to FIG. 25 and FIG. 26, a plurality of second gate driving blocks (220A-1 to 220A-5) of the first sub-gate driver 220A sequentially output the second gate signals (SyA[1] to SyA[5]) having a gate-on voltage for each gate-on period (OnP) for one frame. A plurality of second gate driving blocks (220B-1 to 220B-5) of the second sub-gate driver 220B sequentially output the second gate signals (SyB[1] to SyB[5]) having a gate-on voltage for each gate-on period (OnP) for one frame. A plurality of second gate driving blocks (220C-1 to 220C-5) of the third sub-gate driver 220C sequentially output the second gate signals (SyC[1] to SyC[5]) having a gate-on voltage for each gate-on period (OnP) for one frame. As described, the first sub-gate driver 220A, the second sub-gate driver 220B, and the third sub-gate driver 220C may output the second gate signals (SyA[1] to SyA[5], SyB[1] to SyB[5], and SyC[1] to SyC[5]) with a gate-on voltage, respectively, in the same period.

A plurality of first gate driving blocks (210-1 to 210-6) sequentially output the first gate signals (Sx[1] to Sx[6])

each having a gate-on voltage for corresponding horizontal periods 1H for each gate-on period (OnP).

In synchronization with a plurality of first gate signals (Sx[1] to Sx[6]) with a gate-on voltage, the data driver 300 may apply a plurality of first data signals (data1) to the first data line DL1, a plurality of second data signals (data2) to the second data line DL2, and a plurality of third data signals (data3) to the third data line DL3.

Accordingly, as shown in FIG. 26, a plurality of first data signals (data1) may be input to a plurality of pixels PX provided in the first region (A) in the first order for each column. A plurality of second data signals (data2) may be input to a plurality of pixels PX provided in the second region (B) in the first order for each column. A plurality of third data signals (data3) may be input to a plurality of pixels PX provided in the third region (C) in the first order for each column. That is, the first data signal (data1) is sequentially input to a plurality of pixels PX provided in the first region (A) in the progressing direction of an arrow shown in FIG. 26, the second data signal (data2) is sequentially input to a plurality of pixels PX provided in the second region (B), and the third data signal (data3) is sequentially input to a plurality of pixels PX provided in the third region (C).

Figure 27:
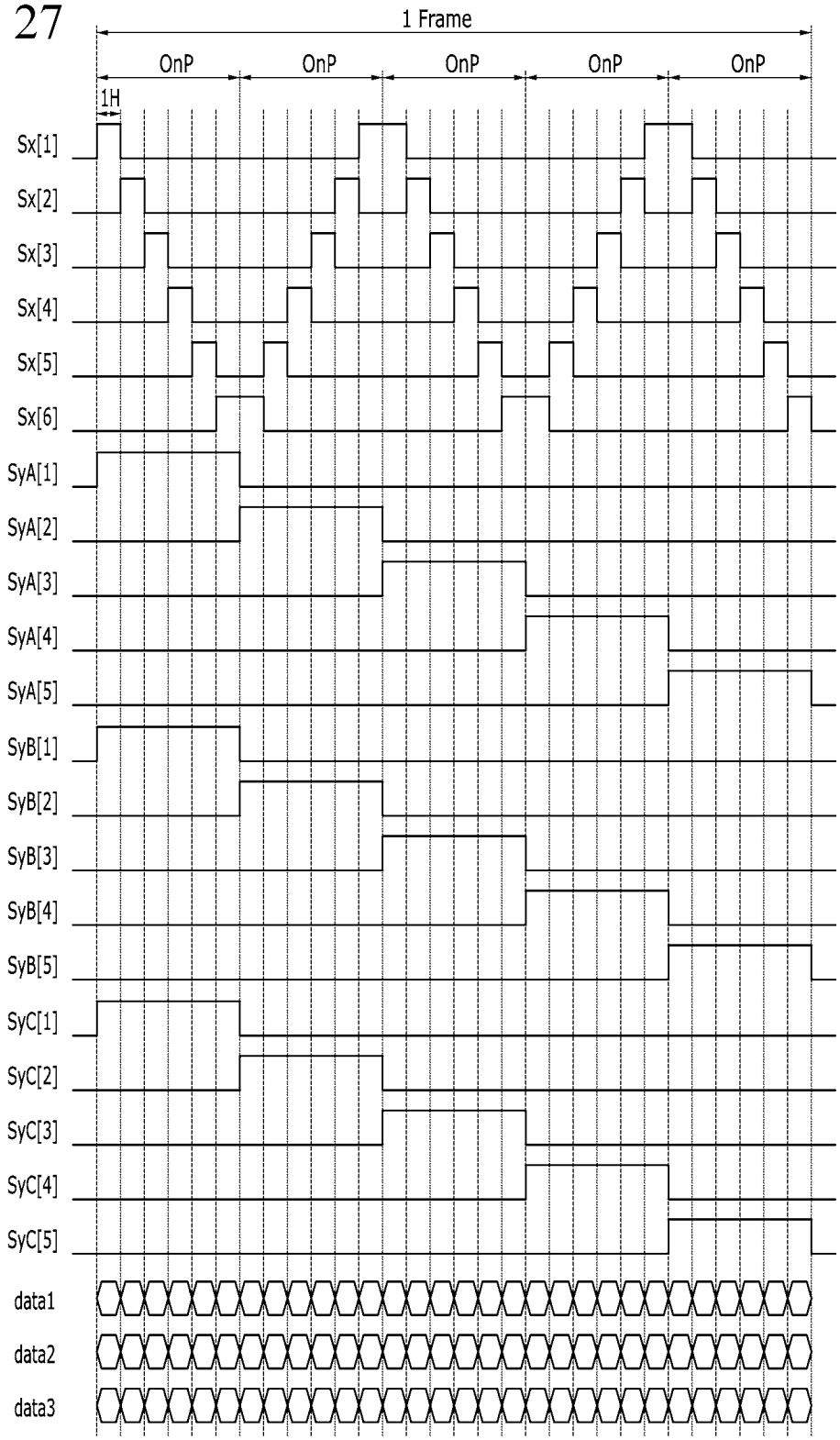
FIG. 27 shows a timing diagram of a method for driving a display device according to an embodiment.
Figure 28:
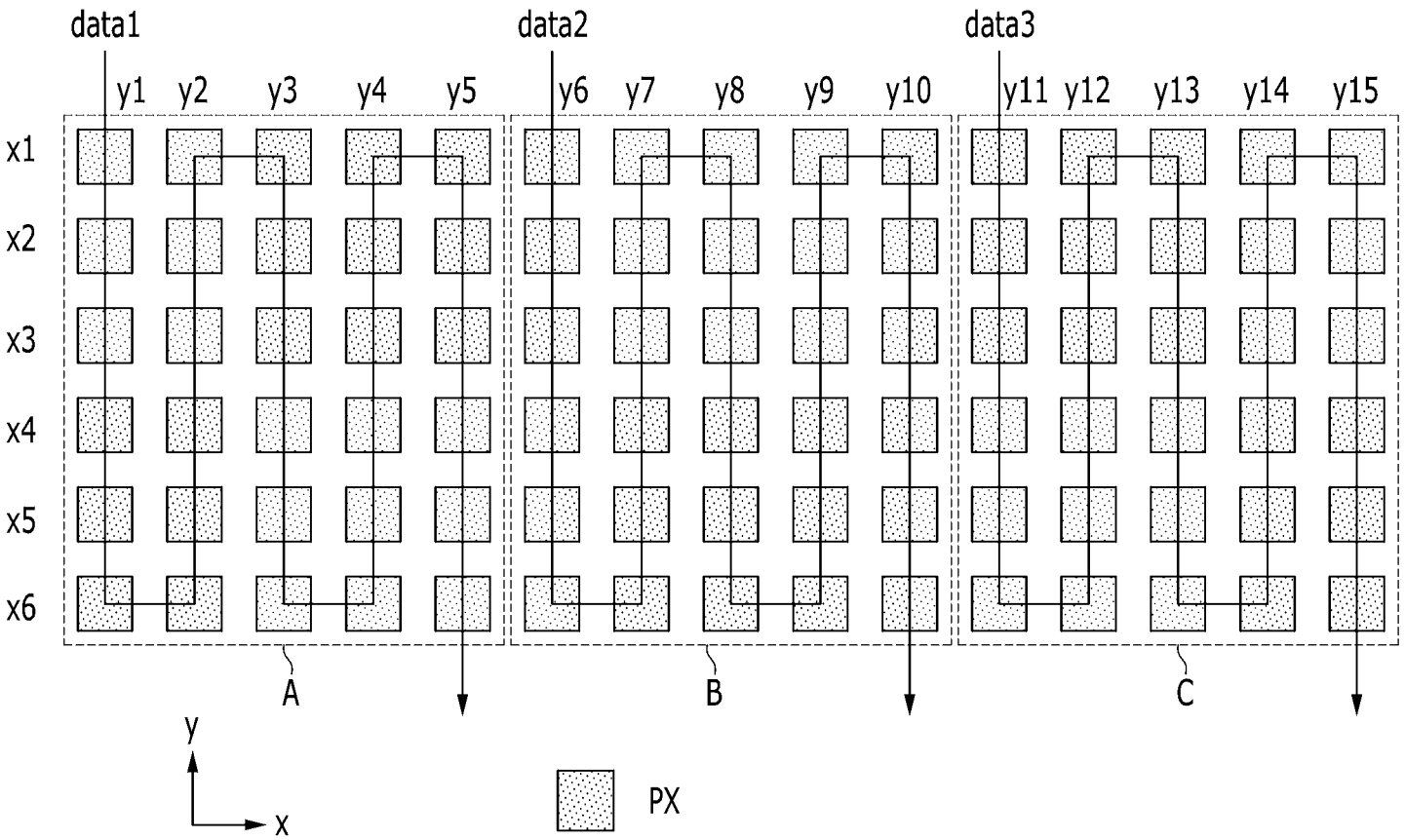
FIG. 28 shows an order for inputting a data signal to a plurality of pixels according to a method for driving a display device according to an embodiment.

FIG. 27 shows a timing diagram of a method for driving a display device of FIG. 24 according to an embodiment. FIG. 28 shows an order for inputting a data signal to a plurality of pixels according to a method for driving a display device of FIG. 27.

Referring to FIG. 27 and FIG. 28, a plurality of second gate driving blocks (220A-1 to 220A-5) of the first sub-gate driver 220A sequentially output the second gate signal (SyA[1] to SyA[5]) having a gate-on voltage for each gate-on period (OnP) for one frame. A plurality of second gate driving blocks (220B-1 to 220B-5) of the second sub-gate driver 220B sequentially output the second gate signals (SyB[1] to SyB[5]) having a gate-on voltage for each gate-on period (OnP) for one frame. A plurality of second gate driving blocks (220C-1 to 220C-5) of the third sub-gate driver 220C sequentially output the second gate signals (SyC[1] to SyC[5]) having a gate-on voltage for each gate-on period (OnP) for one frame.

A plurality of first gate driving blocks (210-1 to 210-6) sequentially output the first gate signals (Sx[1] to Sx[6]) each having a gate-on voltage for consecutive horizontal periods 1H for each gate-on period (OnP), and the orders for applying a plurality of first gate signals (Sx[1] to Sx[6]) to a plurality of first gate lines (Gx1 to Gx6) for each gate-on period (OnP) is alternated between the first order and the second order.

A plurality of first data signals (data1) are applied to the first data line DL1 in synchronization with a plurality of first gate signals (Sx[1] to Sx[6]) with a gate-on voltage, a plurality of second data signals (data2) are applied to the second data line DL2, and a plurality of third data signals (data3) are applied to the third data line DL3.

Therefore, as shown in FIG. 28, the first data signal (data1) is input in the first order in the odd-numbered columns (y1, y3, and y5) for a plurality of pixels PX provided in a first region (A), it is input in the second order in the even-numbered columns (y2 and y4), and the inputting of the first data signal (data1) may be performed from the first column (y1) to the fifth column (y5). The second data signal (data2) is input in the first order in the even-numbered columns (y6, y8, and y10) for a plurality of pixels PX provided in a second region (B), it is input in the second order in the odd-numbered columns (y7 and y9), and the inputting of the second data signal (data2) may be performed from the sixth column (y6) to the tenth column (y10). The third data signal (data3) is input in the first order in the odd-numbered columns (y11, y13, and y15) for a plurality of pixels PX provided in a third region (C), it is input in the second order in the even-numbered columns (y12 and y14), and the inputting of the third data signal (data3) may be performed from the eleventh column (y11) to the fifteenth column (y15).

Figure 29:
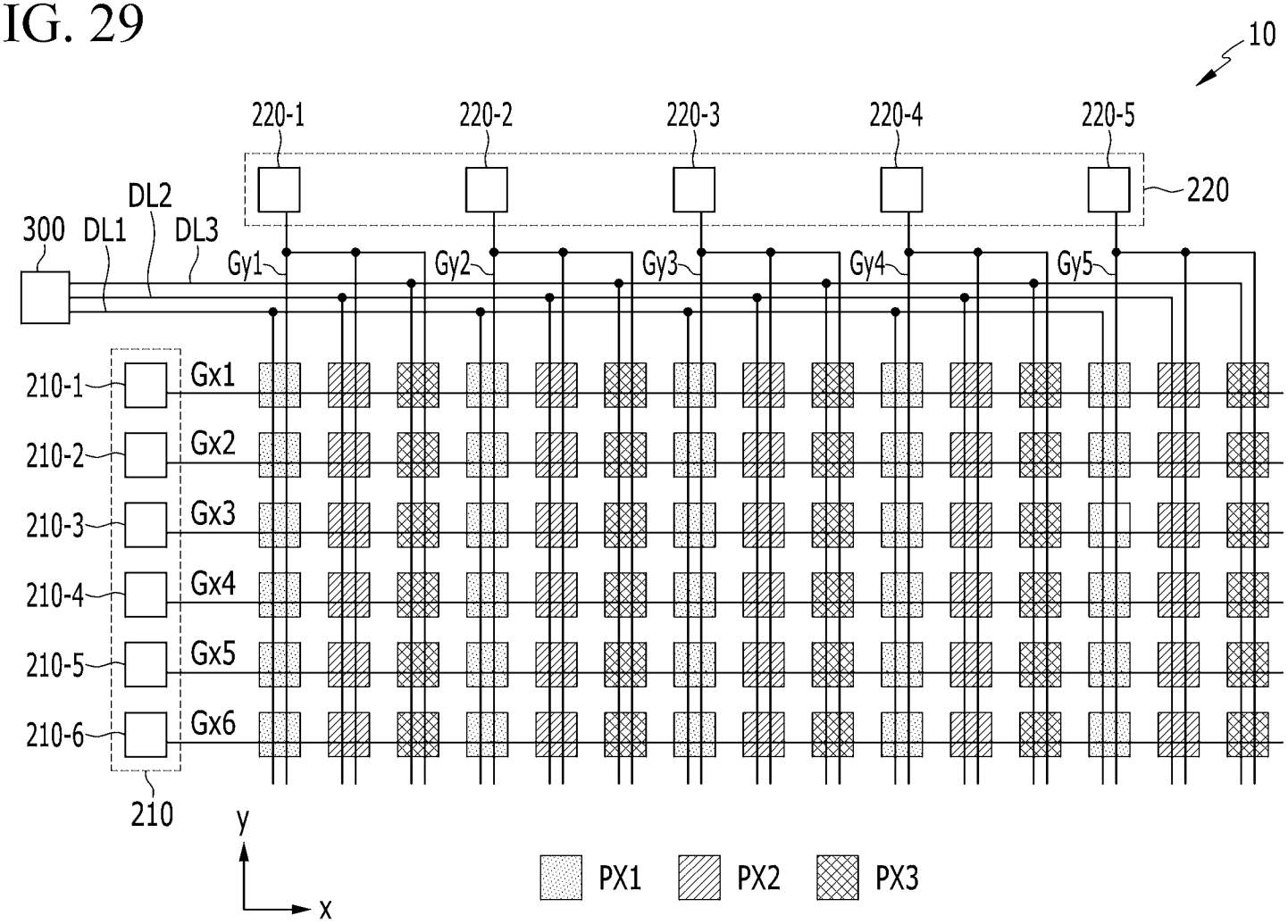
FIG. 29 shows a block diagram of a display device according to an embodiment.

A method for driving a display device with a display device of FIG. 29 as an example, and an order for inputting a data signal to a plurality of pixels, is described.

FIG. 29 shows a block diagram of a display device according to an embodiment. Differences from the display device described with reference to FIG. 15 will be generally described.

Referring to FIG. 29, a plurality of pixels include a plurality of first pixels PX1, a plurality of second pixels PX2, and a plurality of third pixels PX3 having different colors. The first pixels PX1 may be red pixels for emitting red light, the second pixels PX2 may be green pixels for emitting green light, and the third pixels PX3 may be blue pixels for emitting blue light. A plurality of first pixels PX1 may be arranged as a first color array in the second direction (y), a plurality of second pixels PX2 may be provided near the first column and may be arranged as a second color array in the second direction (y), and a plurality of third pixels PX3 may be provided in the second array and may be arranged as a third color array in the second direction (y). The first color array of the first pixels PX1, the second color array of the second pixels PX2, and the third color array of the third pixels PX3 may be repeatedly disposed in the first direction (x).

A plurality of second gate lines (Gy1 to Gy5) may be divided into three wires, respectively, to extend in the second direction (y) along three nearby color arrays and be connected to a plurality of first pixels PX1 of the first color array, a plurality of second pixels PX2 of the second color array, and a plurality of third pixels PX3 of the third color array.

The second gate driver 220 includes a plurality of second gate driving blocks (220-1 to 220-5) connected to a plurality of second gate lines (Gy1 to Gy5).

The data line connected to the data driver 300 may include a first data line DL1 connected to a plurality of first pixels PX1, a second data line DL2 connected to a plurality of second pixels PX2, and a third data line DL3 connected to a plurality of third pixels PX3. The first data line DL1 may be connected to all first pixels PX1, the second data line DL2 may be connected to all second pixels PX2, and the third data line DL3 may be connected to all third pixel PX3.

Except for the above-noted differences, characteristics of an embodiment described with reference to FIG. 15 are applicable to an embodiment described with reference to FIG. 29.

Figure 30:
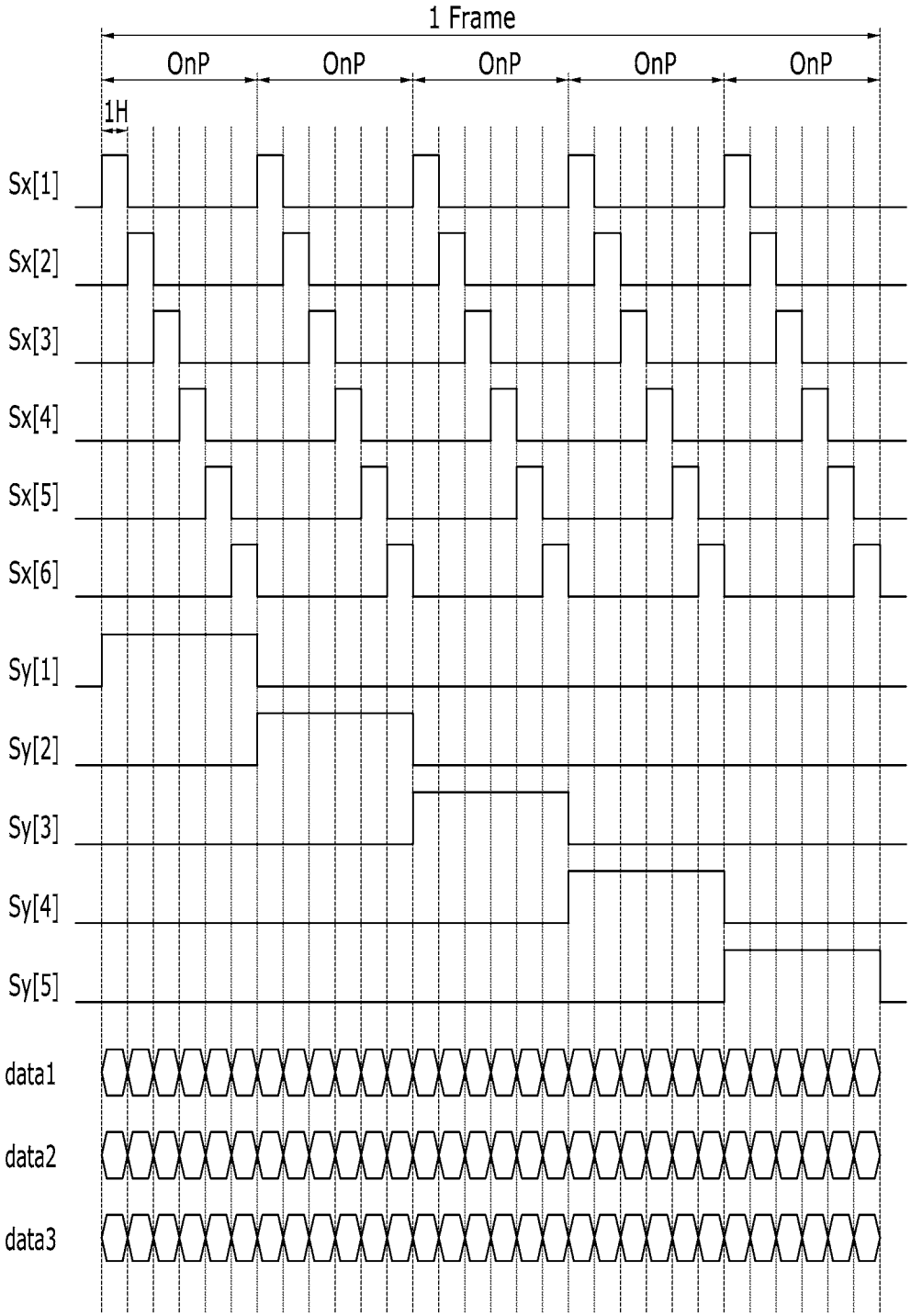
FIG. 30 shows a timing diagram of a method for driving a display device according to an embodiment.
Figure 31:
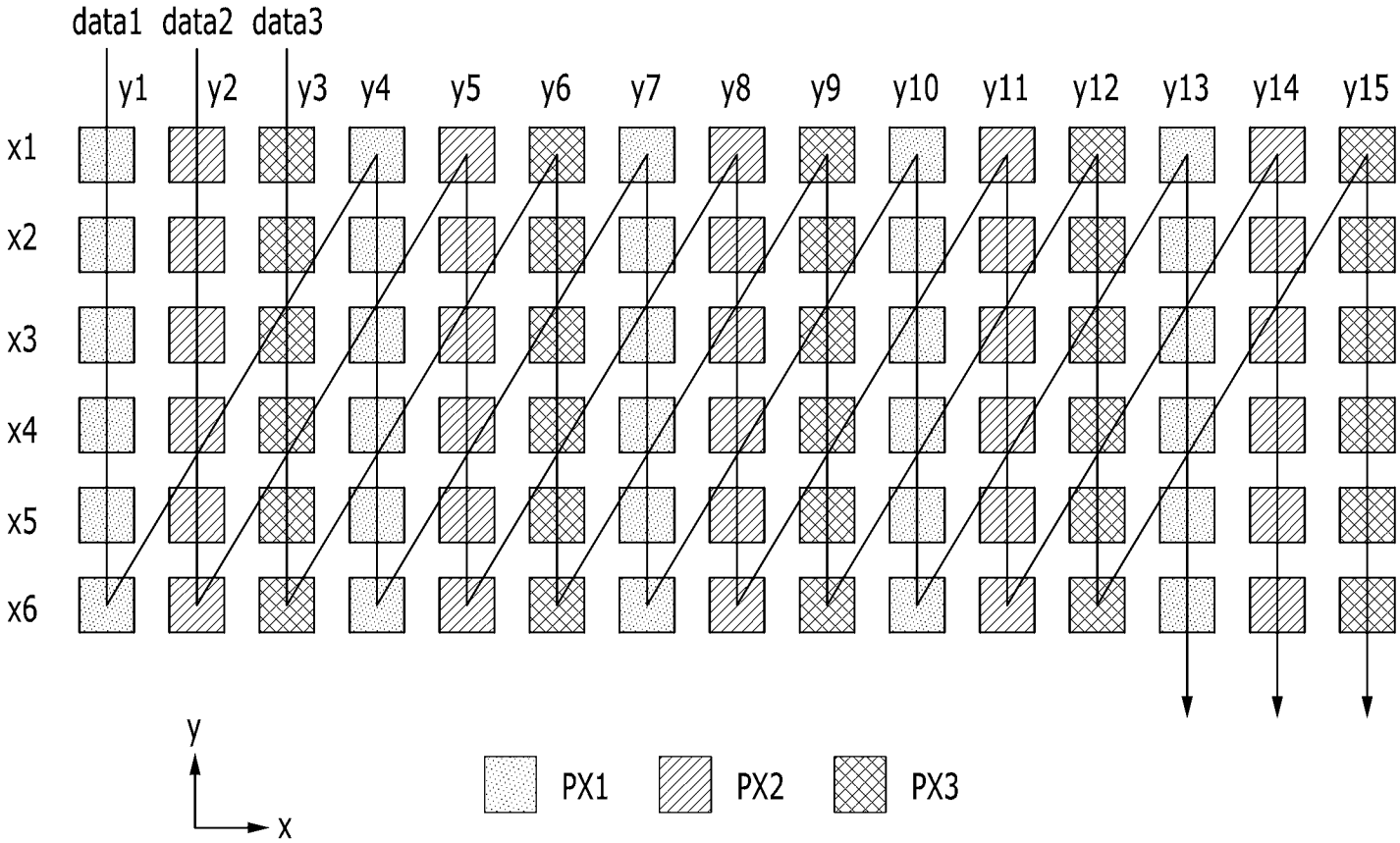
FIG. 31 shows an order for inputting a data signal to a plurality of pixels according to a method for driving a display device according to an embodiment.

FIG. 30 shows a timing diagram of a method for driving a display device of FIG. 29 according to an embodiment. FIG. 31 shows an order for inputting a data signal to a plurality of pixels according to a method for driving a display device of FIG. 30.

Referring to FIG. 30 and FIG. 31, a plurality of second gate driving blocks (220-1 to 220-5) sequentially output the second gate signals (Sy[1] to Sy[5]) having a gate-on voltage for each gate-on period (OnP) for one frame.

A plurality of first gate driving blocks (210-1 to 210-6) sequentially output the first gate signals (Sx[1] to Sx[6]) each having a gate-on voltage for corresponding horizontal periods 1H for each gate-on period (OnP).

In synchronization with a plurality of first gate signals (Sx[1] to Sx[6]) with a gate-on voltage, the data driver 300 may apply a plurality of first data signals (data1) to the first data line DL1, a plurality of second data signals (data2) to the second data line DL2, and a plurality of third data signals (data3) to the third data line DL3. A plurality of first data signals (data1) may be data signals that correspond to a plurality of first pixels PX1, a plurality of second data signals (data2) may be data signals that correspond to a plurality of second pixels PX2, and a plurality of third data signals (data3) may be data signals that correspond to a plurality of third pixels PX3.

Accordingly, as shown in FIG. 31, a plurality of first data signals (data1) may be input to a plurality of first pixels PX1 in the first order for each first color array of a plurality of first pixels PX1. The first color array includes a first column (y1), a fourth column (y4), a seventh column (y7), a tenth column (y10), and a thirteenth column (y13). The first data signal (data1) may be input in the order of the first column (y1), the fourth column (y4), the seventh column (y7), the tenth column (y10), and the thirteenth column (y13).

A plurality of second data signals (data2) may be input to a plurality of second pixels PX2 in the first order for each second color array of a plurality of second pixels PX2. The second color array includes a second column (y2), a fifth column (y5), an eighth column (y8), an eleventh column (y11), and a fourteenth column (y14). The second data signal (data2) may be input in the order of the second column (y2), the fifth column (y5), the eighth column (y8), the eleventh column (y11), and the fourteenth column (y14).

A plurality of third data signals (data3) may be input to a plurality of third pixels PX3 in the first order for each third color array of a plurality of third pixels PX3. The third color array includes a third column (y3), a sixth column (y6), a ninth column (y9), a twelfth column (y12), and a fifteenth column (y15). The third data signal (data3) may be input in the order of the third column (y3), the sixth column (y6), the ninth column (y9), the twelfth column (y12), and the fifteenth column (y15).

That is, the first data signal (data1), the second data signal (data2), and the third data signal (data3) may be sequentially input to a plurality of first pixels PX1, a plurality of second pixels PX2, and a plurality of third pixels PX3 in the progressing direction of an arrow shown in FIG. 31.

Figure 32:
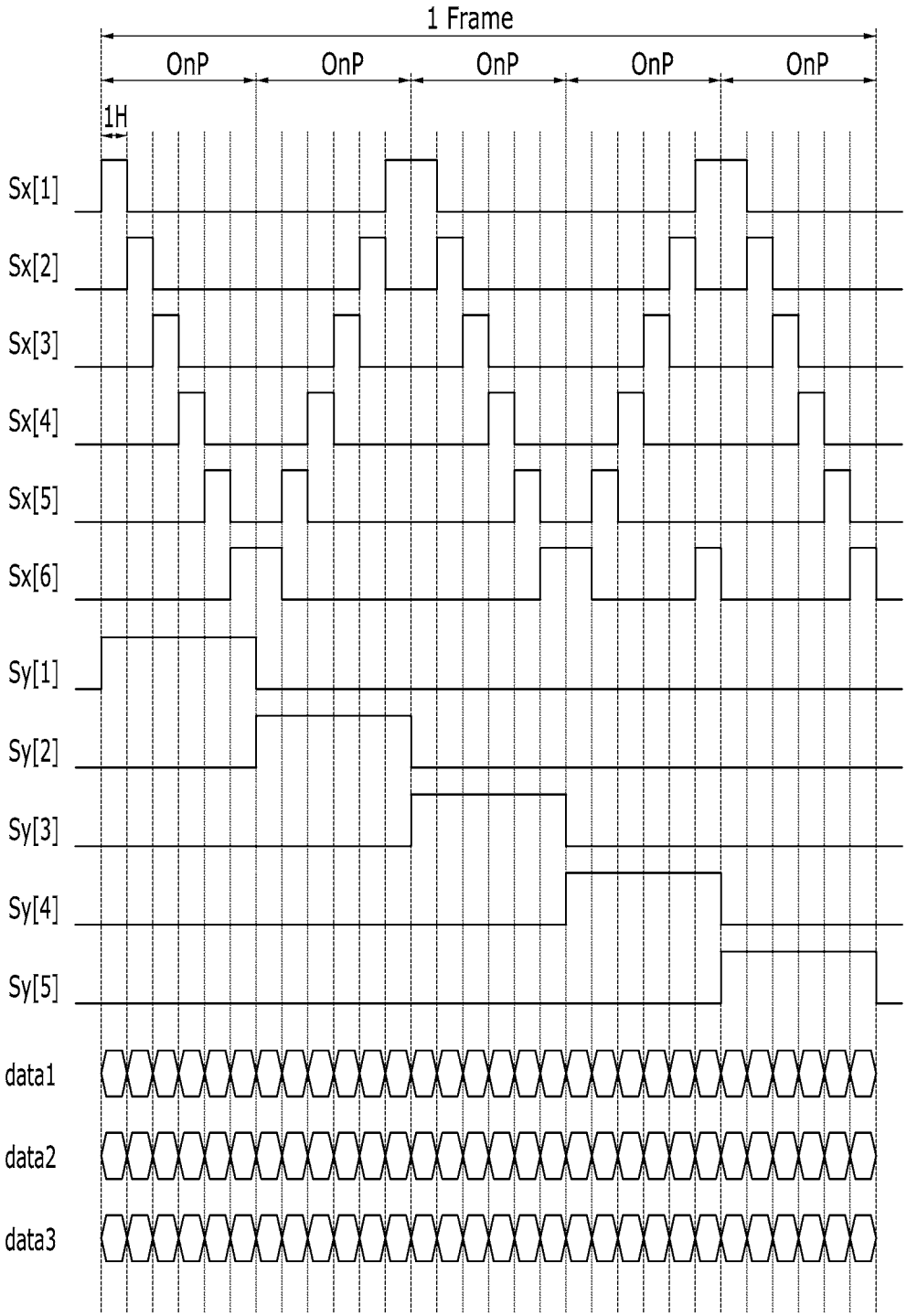
FIG. 32 shows a timing diagram of a method for driving a display device according to an embodiment.
Figure 33:
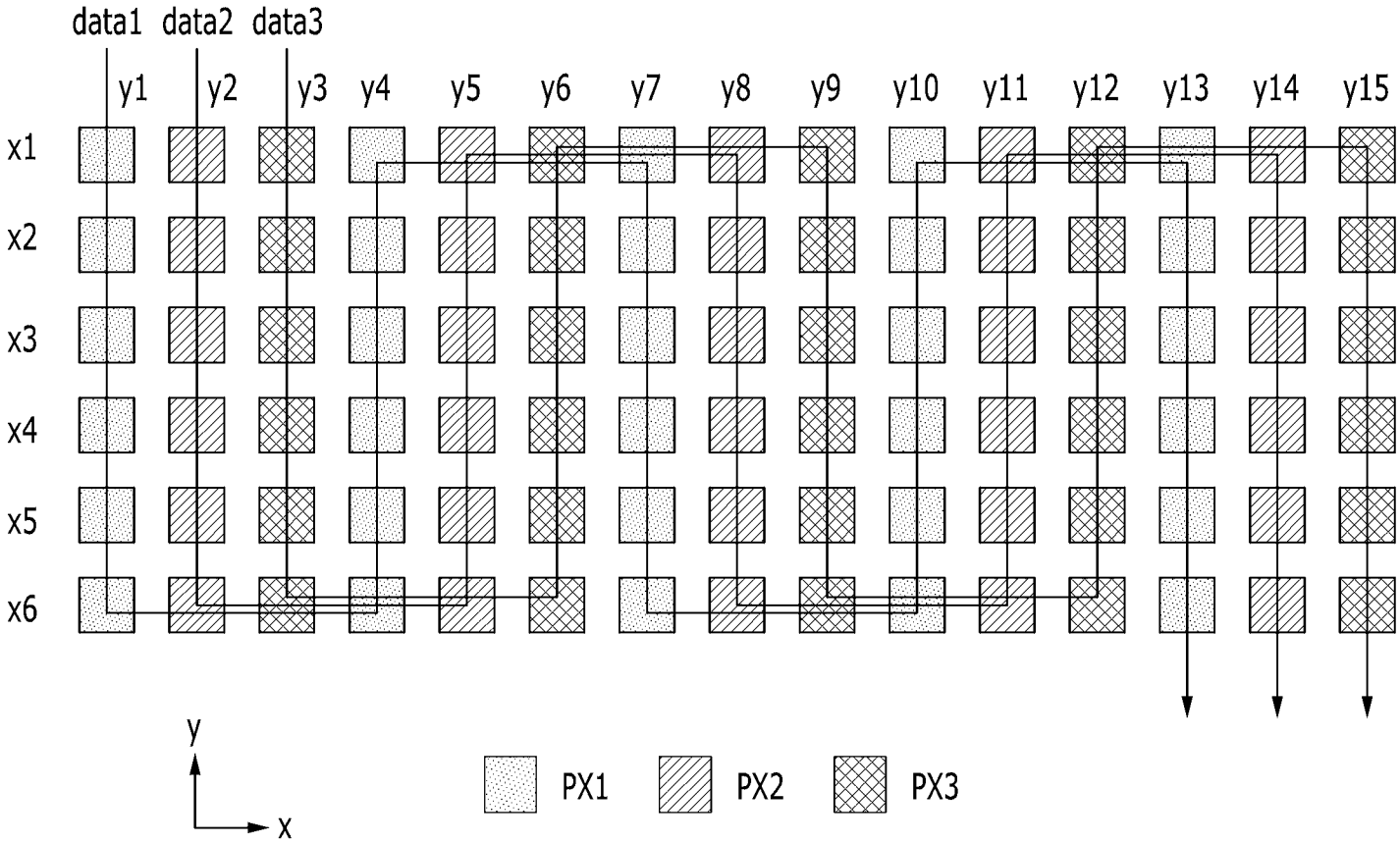
FIG. 33 shows an order for inputting a data signal to a plurality of pixels according to a method for driving a display device according to an embodiment.

FIG. 32 shows a timing diagram of a method for driving a display device of FIG. 29 according to an embodiment. FIG. 33 shows an order for inputting a data signal to a plurality of pixels according to a method for driving a display device of FIG. 32.

Referring to FIG. 32 and FIG. 33, a plurality of second gate driving blocks (220-1 to 220-5) sequentially output the second gate signals (Sy[1] to Sy[5]) having a gate-on voltage for each gate-on period (OnP) for one frame.

A plurality of first gate driving blocks (210-1 to 210-6) sequentially output the first gate signals (Sx[1] to Sx[6]) each having a gate-on voltage for corresponding horizontal periods 1H for each gate-on period (OnP), and they alternately change the order of applying a plurality of first gate signals (Sx[1] to Sx[6]) to a plurality of first gate lines (Gx1 to Gx6) between the first order and the second order for each gate-on period (OnP).

In synchronization with a plurality of first gate signals (Sx[1] to Sx[6]) with a gate-on voltage, a plurality of first data signals (data1) are applied to the first data line DL1, a plurality of second data signals (data2) are applied to the second data line DL2, and a plurality of third data signals (data3) are applied to the third data line DL3.

Therefore, as shown in FIG. 33, a plurality of first data signals (data1) may be input to a plurality of first pixels PX1 provided in the first color array in the first order in the odd-numbered columns (y1, y7, and y13), and may be input thereto in the second order in the even-numbered columns (y4 and y10). The first data signal (data1) may be input in the order of the first column (y1), the fourth column (y4), the seventh column (y7), the tenth column (y10), and the thirteenth column (y13).

A plurality of second data signals (data2) may be input to a plurality of second pixels PX2 provided in the second color array in the first order in the even-numbered columns (y2, y8, and y14), and may be input in the second order in the odd-numbered columns (y5 and y11). The second data signal (data2) may be input in the order of the second column (y2), the fifth column (y5), the eighth column (y8), the eleventh column (y11), and the fourteenth column (y14).

A plurality of third data signals (data3) may be input to a plurality of third pixels PX3 provided in the third color array in the first order in the odd-numbered columns (y3, y9, and y15), and may be input thereto in the second in the even-numbered columns (y6 and y12). The third data signal (data3) may be input in the order of the third column (y3), the sixth column (y6), the ninth column (y9), the twelfth column (y12), and the fifteenth column (y15).

That is, the first data signal (data1), the second data signal (data2), and the third data signal (data3) may be sequentially input to a plurality of first pixels PX1, a plurality of second pixels PX2, and a plurality of third pixels PX3 in the progressing direction of an arrow shown in FIG. 33.

A display device in which a display area is not formalized to be a quadrangle is described with reference to FIG. 34.

Figure 34:
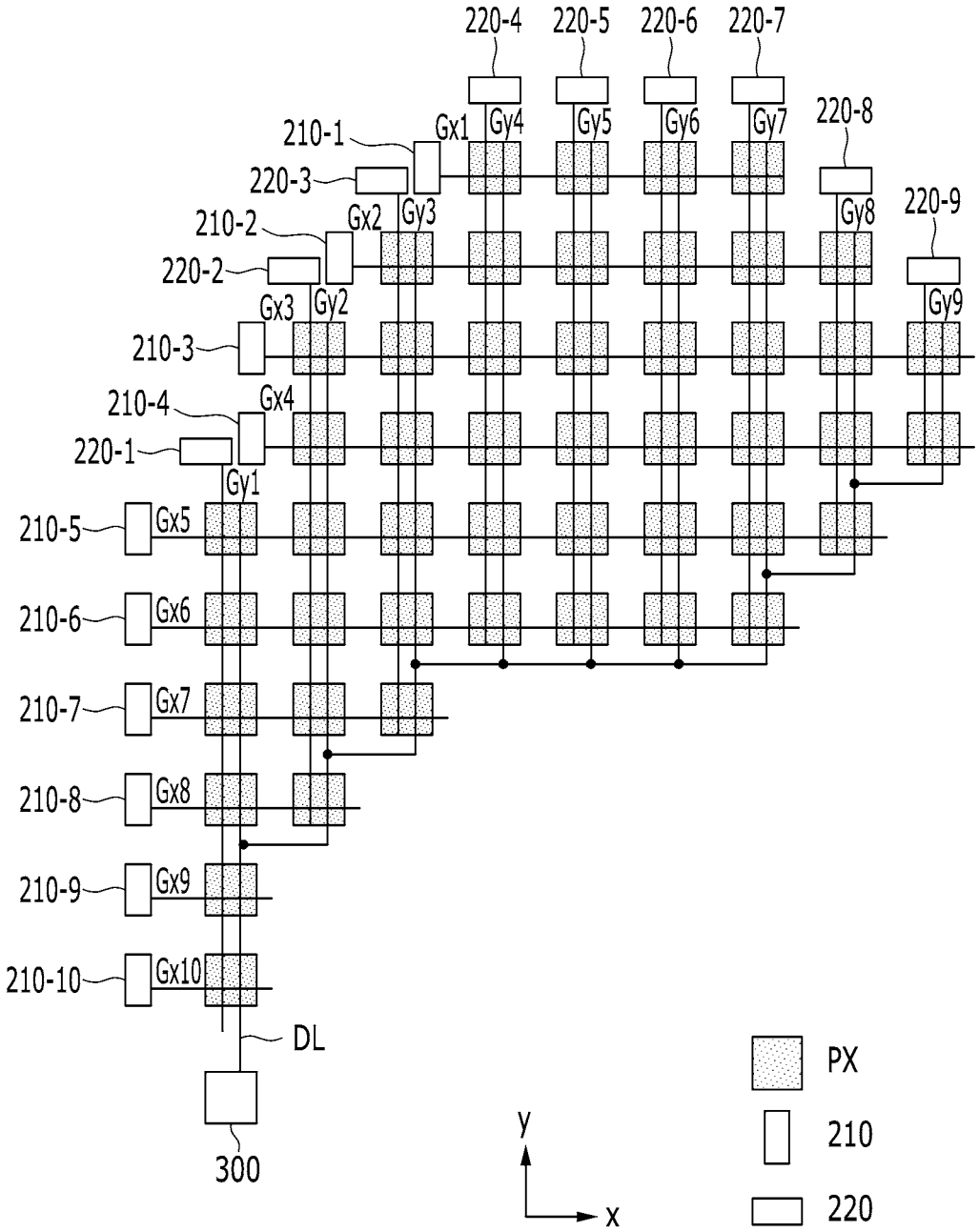
FIG. 34 shows a block diagram of a display device according to an embodiment.

FIG. 34 shows a block diagram of a display device according to an embodiment.

Referring to FIG. 34, a display area including a plurality of pixels PX may be a circle or a random polygon, not the quadrangle. In this instance, a plurality of pixels PX are arranged in the first direction (x) and the second direction (y), and the number of pixels PX arranged in the first direction (x) may be changed according to the second direction (y) and the number of pixels PX arranged in the second direction (y) may be changed according to the first direction (x).

A number of the first gate lines (Gx1 to Gx10) that may be entirely connected to a plurality of pixels PX extend in the first direction (x). A number of the second gate lines (Gy1 to Gy9) that may be entirely connected to a plurality of pixels PX extend in the second direction (y).

A plurality of first gate driving blocks (210-1 to 210-10) are provided on an edge of the display area in which a plurality of pixels PX are disposed, and are connected to a plurality of first gate lines (Gx1 to Gx10). A number of a plurality of first gate driving blocks (210-1 to 210-10) may correspond to the number a plurality of first gate lines (Gx1 to Gx10).

Second gate driving blocks (220-1 to 220-9) are provided on an edge of the display area, and are connected to a plurality of second gate lines (Gy1 to Gy9). A number of second gate driving blocks (220-1 to 220-9) may correspond to the number of second gate lines (Gy1 to Gy9).

The data line (DL) may extend in the first direction (x) and the second direction (y) along the arranged direction of a plurality of pixels PX, and may be connected each of the pixels PX in the display area. An end of the data line (DL) is connected to the data driver 300, and the data driver 300 may apply the data signal to a plurality of pixels PX through one data line (DL).

As described, when the display area including a plurality of pixels PX has a circular shape or a particular polygonal shape, the data signal may be applied to a plurality of pixels PX by use of one data line (DL). Therefore, the width of the flexible circuit board for connecting the data driver 300 in the display device with a desirable circular shape or a desirable polygonal shape can be minimized.

The drawings and embodiments are illustrative examples and do not limit the scope defined by the following claims. Various modifications and embodiments may be made without departing from the scope defined by the following claims.

What is claimed is:

1. A display device comprising:

a display area including a plurality of pixels arranged consecutively in a first direction and a second direction traversing the first direction;

a plurality of first-type gate lines including a first gate line and extending in the first direction and parallel to one another;

a plurality of second-type gate lines including a second gate line and extending in the second direction;

a first data line electrically connected in common to all of the pixels included in the display area;

a data driver connected to the first data line and sequentially applying data signals to the all of the pixels included in the display area through the first data line; and a first pixel including a first switching transistor and a second switching transistor, wherein the first switching transistor includes a first gate electrode, a first source electrode, and a first drain electrode, wherein the first gate electrode is electrically connected to the first gate line, wherein the first source electrode is electrically connected to the first data line, wherein the second switching transistor includes a second gate electrode, a second source electrode, and a second drain electrode, wherein the second gate electrode is electrically connected to the second gate line, and wherein the second source electrode is electrically connected to the first drain electrode.

2. The display device of claim 1, further comprising:

a liquid crystal capacitor electrically connected to the second drain electrode.

3. The display device of claim 1, further comprising:

a driving transistor electrically connected to the second switching transistor; and a light emitting diode electrically connected to the driving transistor.

4. The display device of claim 1, wherein the first gate line extends in one of a pixel row direction and a pixel column direction, and wherein the second gate line extends in another of the pixel row direction and the pixel column direction.

5. The display device of claim 1, wherein the first-type gate lines include a third gate line, and wherein a total number of all pixels electrically connected to the first gate line is unequal to a total number of all pixels electrically connected to the third gate line.

6. The display device of claim 1, further comprising: a second pixel electrically connected to the first data line, wherein the first-type gate lines include a third gate line electrically connected to the second pixel, and wherein the second-type gate lines include a fourth gate line electrically connected to the second pixel.

7. The display device of claim 1, further comprising:

first-type gate driving units respectively electrically connected to the first-type gate lines for respectively outputting first-type gate signals to the first-type gate lines; and second-type gate driving units respectively electrically connected to the second-type gate lines for respectively outputting second-type gate signals to the second-type gate lines.

8. The display device of claim 7, wherein when the first gate line continues transmitting a first copy of a gate-on voltage to the first pixel for a first gate-on period, some or all of the second-type gate driving units sequentially output a first plurality of copies of a gate-on signal in a first plurality of consecutive horizontal periods, and wherein a length the first gate-on period is equal to a total length of the first plurality of consecutive horizontal periods.

9. The display device of claim 7, wherein the first-type gate lines includes a third gate line immediately neighboring the first gate line, wherein when the third gate line continues transmitting a second copy of the gate-on voltage for a second gate-on period, the some or all of the second-type gate driving units sequentially output a second plurality of copies of the gate-on signal in a second plurality of consecutive horizontal periods, and wherein a length the second gate-on period is equal to a total length of the second plurality of consecutive horizontal periods.

10. The display device of claim 9, wherein the some or all of the second-type gate driving units sequentially output the first plurality of copies of the gate-on signal in a first order, and wherein the some or all of the second-type gate driving units sequentially output the second plurality of copies of the gate-on signal in a second order that is an inverse order of the first order.

11. A display device comprising:

a first display area including a plurality of pixels arranged consecutively in a first direction and a second direction traversing the first direction;

a plurality of first-type gate lines;

a plurality of second-type gate lines traversing the first-type gate lines;

first-type gate driving units respectively electrically connected to the first-type gate lines;

second-type gate driving units respectively electrically connected to the second-type gate lines;

a first data line electrically connected in common to all of the pixels included in the display area; and a data driver connected to the first data line and sequentially applying data signals to the all of the pixels included in the display area through the first data line.

12. The display device of claim 11, wherein during a gate-on period in which one of the first-type gate driving units outputs a first copy of a first gate signal, the second-type gate driving units sequentially output a first plurality of copies of a second gate signal to the second-type gate lines.

13. The display device of claim 12, wherein the first gate-type driving units sequentially output copies of the first gate signal to the first-type gate lines for one frame.

14. The display device of claim 13, wherein when each of the first gate driving units outputs a copy of the first gate signal, the second-type gate driving units sequentially output a plurality of copies of the second gate signal to the second-type gate lines.

15. The display device of claim 13, wherein the second-type gate driving units alternate orders of applying pluralities of copies of the second gate signal to the second-type gate lines between a first order and a second order that is an inverse order of the first order in consecutive gate-on periods.

16. The display device of claim 11, wherein the pixels have gate electrodes electrically connected to the first-type gate lines and the second-type gate lines, arranged in pixel rows and pixel columns, and including a first pixel, the first pixel being electrically connected to both one of the first-type gate lines and one of the second-type gate lines.

17. The display device of claim 16, wherein the first data line is electrically connected to pixels positioned in different ones of the pixel rows and is electrically connected to pixels positioned in different ones of the pixel columns.

18. The display device of claim 17, further comprising:

a second display area including a plurality of pixels arranged consecutively in the first direction and the second direction traversing the first direction; and a second data line electrically insulated from the first data line, wherein the second data line is electrically connected in common to all of the plurality of pixels in the second display area.

19. The display device of claim 16, further comprising:

a second data line electrically insulated from the first data line; and a third data line electrically insulated from each of the first data line and the second data line, wherein the pixels include a plurality of first-color pixels of a first color, a plurality of second-color pixels of a second color, and a plurality of third-color pixels of a third color, wherein the first data line is electrically connected to a source electrode of each of the first-color pixels, wherein the second data line is electrically connected to a source electrode of each of the second-color pixels, and wherein the third data line is electrically connected to a source electrode of each of the third-color pixels.

20. The display device of claim 11, wherein each of the pixels is electrically connected to at least one of the first-type gate lines and at least one of the second-type gate lines, wherein the first-type gate lines include a first gate line and a second gate line, wherein a total number of all pixels electrically connected to the first gate line is unequal to a total number of all pixels electrically connected to the second gate line.

* * * * *